US012606879B2

(12) United States Patent
Sasaki et al.

(10) Patent No.: US 12,606,879 B2
(45) Date of Patent: Apr. 21, 2026

(54) ALLOY PIPE AND METHOD FOR PRODUCING SAME

(71) Applicant: JFE Steel Corporation, Tokyo (JP)

(72) Inventors: Shunsuke Sasaki, Tokyo (JP); Masao Yuga, Tokyo (JP); Tatsuro Katsumura, Tokyo (JP); Hideo Kijima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 643 days.

(21) Appl. No.: 17/925,410

(22) PCT Filed: May 12, 2021

(86) PCT No.: PCT/JP2021/018107

§ 371 (c)(1),
(2) Date: Nov. 15, 2022

(87) PCT Pub. No.: WO2021/256128

PCT Pub. Date: Dec. 23, 2021

(65) Prior Publication Data

US 2023/0183829 A1 Jun. 15, 2023

(30) Foreign Application Priority Data

Jun. 19, 2020 (JP) ..... 2020-105724

(51) Int. Cl.

| | |
|---|---|
| ***C21D 8/10*** | (2006.01) |
| ***C21D 6/00*** | (2006.01) |
| ***C22C 38/60*** | (2006.01) |

(52) U.S. Cl.

CPC ..... *C21D 8/10* (2013.01); *C21D 6/004* (2013.01); *C22C 38/60* (2013.01); *C21D 2211/001* (2013.01)

(58) Field of Classification Search

CPC .. C21D 8/105; C21D 6/004; C21D 2211/001; C21D 1/26; C21D 7/10; C21D 9/08;

(Continued)

(56) References Cited

U.S. PATENT DOCUMENTS

| | | | |
|---|---|---|---|
| 9,429,254 | B2 | 8/2016 | Sawawatari et al. |
| 2021/0292864 | A1 | 9/2021 | Ueyama et al. |
| 2022/0018007 | A1 | 1/2022 | Sasaki et al. |

FOREIGN PATENT DOCUMENTS

| | | | |
|---|---|---|---|
| CN | 104395491 | A | 3/2015 |
| CN | 104946932 | A | 9/2015 |

(Continued)

OTHER PUBLICATIONS

Extended European Search Report for European Application No. 21825664.2, dated Jun. 2, 2023, 8 pages.

(Continued)

*Primary Examiner* — Danielle M. Carda

(74) *Attorney, Agent, or Firm* — Buchanan Ingersoll & Rooney PC

(57) ABSTRACT

An alloy pipe and a method for producing the same are disclosed. The alloy pipe of the present invention contains, as a component composition, in terms of % by mass, Cr: 11.5-35.0%, Ni: 23.0-60.0%, and Mo: 0.5-17.0%, has an austenitic phase as a microstructure, has a Mo concentration (% by mass) in a grain boundary of the austenitic phase that is 4.0 times or less than a Mo concentration (% by mass) within grains of the austenitic phase, and has a tensile yield strength in a pipe axial direction of 689 MPa or more and a ratio (compressive yield strength in a pipe axial direction)/(tensile yield strength in a pipe axial direction) of 0.85 to 1.15.

6 Claims, 3 Drawing Sheets

(58) Field of Classification Search
CPC ..... C21D 8/10; C22C 38/60; C22C 38/002; C22C 38/005; C22C 38/06; C22C 38/008; C22C 38/46; C22C 19/05; C22C 38/42; C22C 38/44; C22C 38/48; C22C 38/50; C22C 38/54; C22C 38/58; C22F 1/10
USPC ..... 148/593
See application file for complete search history.

(56) References Cited

FOREIGN PATENT DOCUMENTS

| | | | | |
|---|---|---|---|---|
| EP | 2690188 | A1 * | 1/2014 | ..... C21D 8/10 |
| EP | 2853614 | A1 | 4/2015 | |
| EP | 3636789 | A1 | 4/2020 | |
| JP | 0790373 | A | 4/1995 | |
| JP | 2006122932 | A | 5/2006 | |
| JP | 2012229457 | A | 11/2012 | |
| JP | 5137048 | B2 | 2/2013 | |
| JP | 2020158816 | A | 10/2020 | |
| WO | 2012128258 | A1 | 9/2012 | |
| WO | 2018225869 | A1 | 12/2018 | |
| WO | 2020110597 | A1 | 6/2020 | |

OTHER PUBLICATIONS

International Search Report and Written Opinion for International Application No. PCT/JP2021/018107, dated Jul. 20, 2021, 7 pages.
Chinese Office Action for Chinese Application No. 202180035912.2, dated Nov. 2, 2023 with Concise Statement of Relevance of Office Action, 4 pages.
Chinese Office Action for Chinese Application No. 202180035919.2, dated Jul. 12, 2023 with Concise Statement of Relevance of Office Action, 12 pages.

* cited by examiner

[FIG. 1]
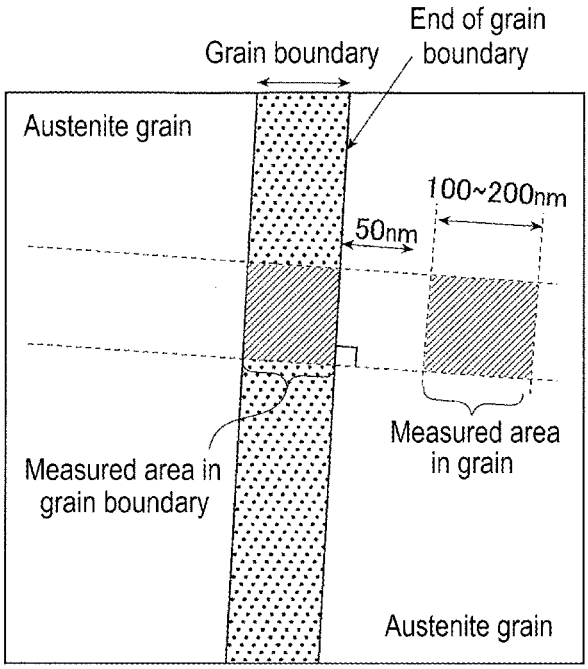
[FIG. 2]
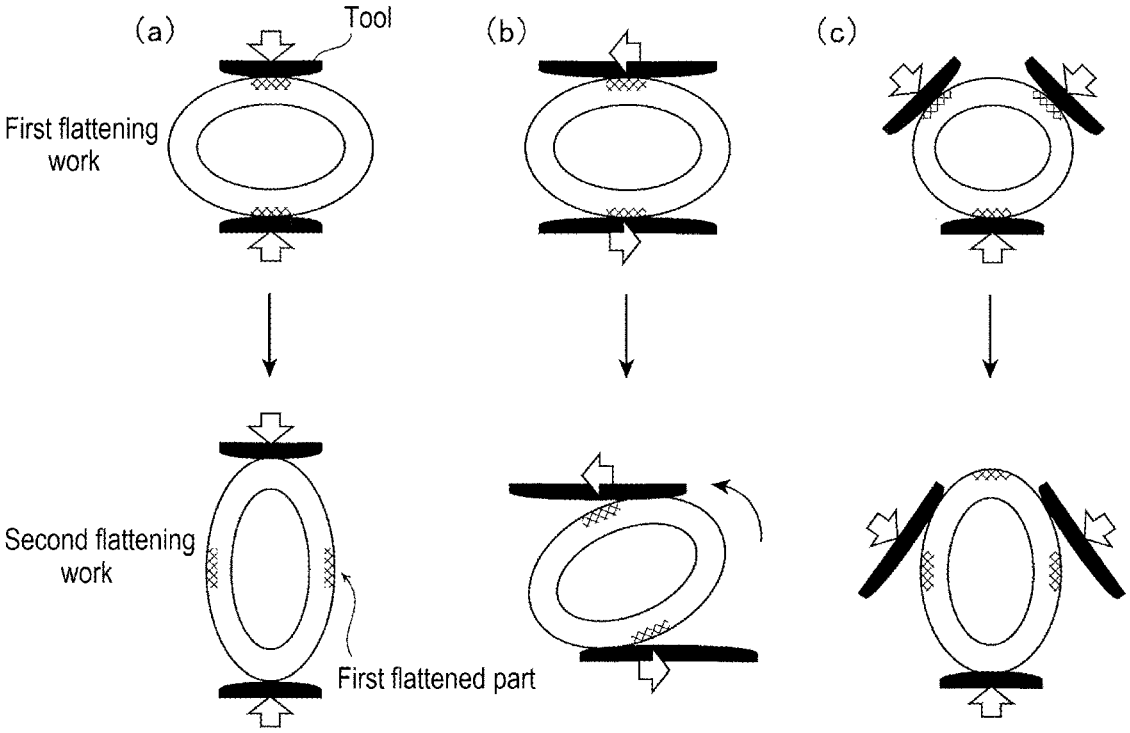

[FIG. 3]
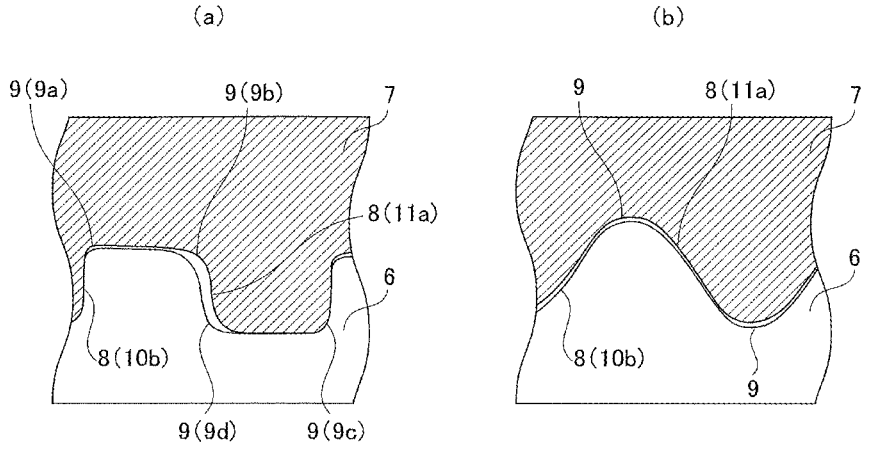
[FIG. 4]
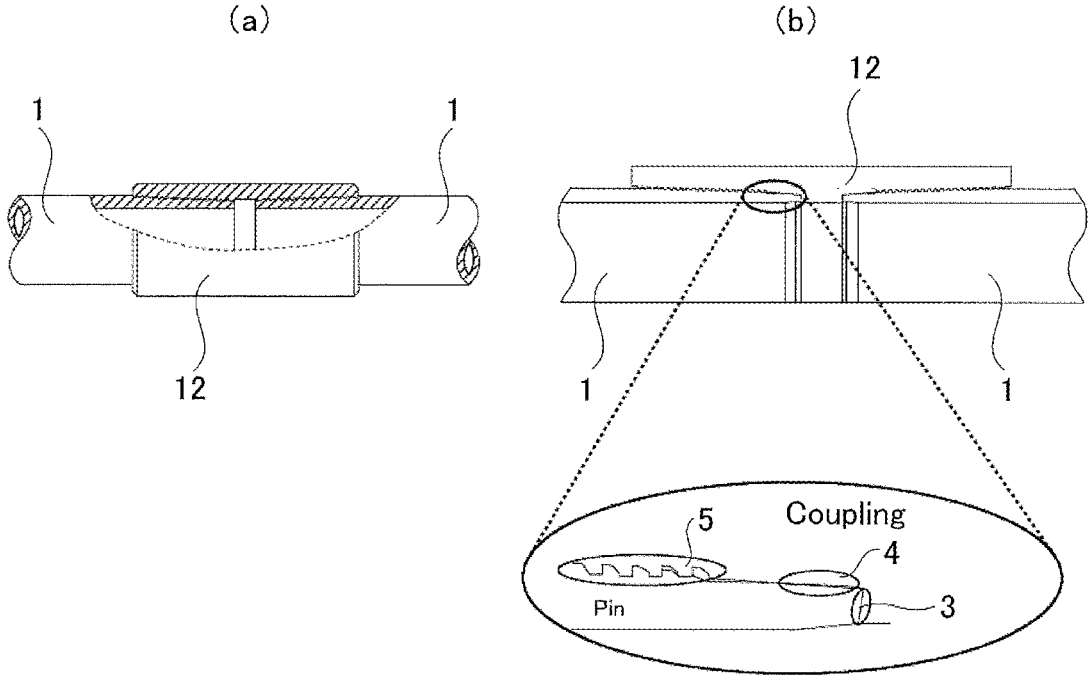

[FIG. 5]
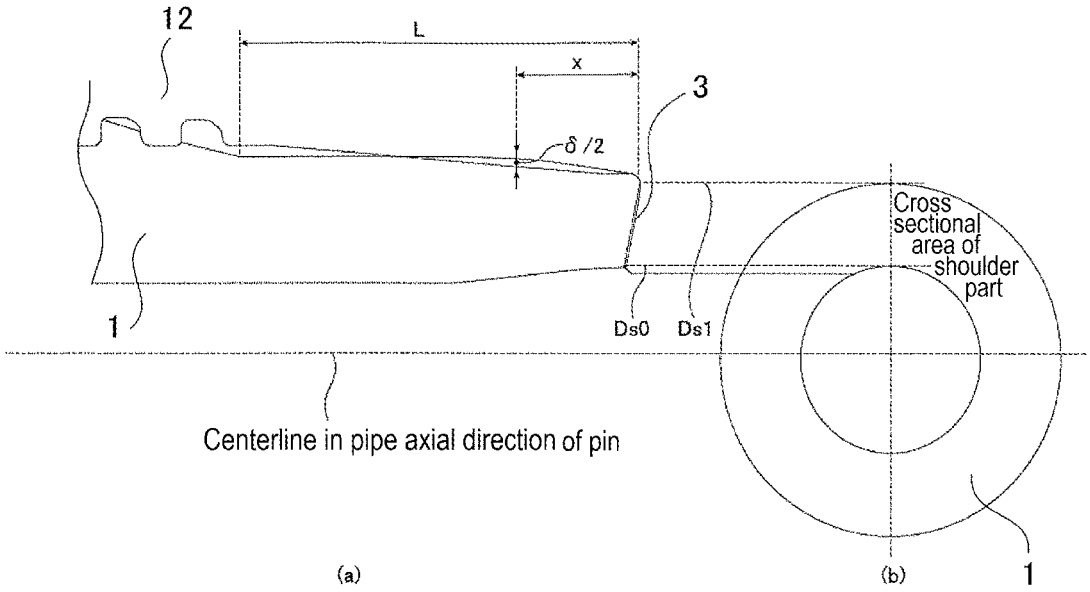

ALLOY PIPE AND METHOD FOR PRODUCING SAME

CROSS REFERENCE TO RELATED APPLICATIONS

This is the U.S. National Phase application of PCT/JP2021/018107, filed May 12, 2021 which claims priority to Japanese Patent Application No. 2020-105724, filed Jun. 19, 2020, the disclosures of these applications being incorporated herein by reference in their entireties for all purposes.

FIELD OF THE INVENTION

The present invention relates to an alloy pipe and a method for producing the same.

BACKGROUND OF THE INVENTION

It is important that alloy pipes, such as seamless alloy pipes for mining in an oil well and a gas well, for mining thermal energy in geothermal power generation, and for piping in a chemical plant, have a corrosion resistance capability of withstanding a severe corrosion environment in a high temperature and high pressure environment in the ground and in an ultralow temperature environment with a cooled corrosive solution, and high strength properties withstanding the own weight and a high pressure in linking to a high depth and an internal pressure of the content under transportation.

As for the corrosion resistance capability, it is necessary to add various corrosion resistance improving elements in combination to an austenitic single phase structure, which is obtained by adding a large amount of Ni to the alloy, and for example, N08028 (UNS number) containing 29.5-32.5% of Ni, N08535 (UNS number) containing 29.0-36.5% of Ni, N08135 (UNS number) containing 33.0-38.0% of Ni, N08825 (UNS number) containing 38.0-46.0% of Ni, and N06255 and N06975 (UNS number) containing 47.0-52.0% of Ni, and in addition, N06985 and N10276 (UNS number) containing up to 60% of Ni have been used.

As for the strength properties, the most important factor is the tensile yield strength in the pipe axial direction, and the value thereof is used as the representative value of the strength specification of the products. This is because what is most important is the capability of withstanding the tensile stress due to the own weight of the pipes and the bending deformation thereof in linking the pipes to a high depth, and the sufficiently large tensile yield strength in the pipe axial direction against the tensile stress suppresses the plastic deformation and prevents the damage of the passivation film, which is important for retaining the corrosion resistance on the surface of the pipe.

While the most important factor in the strength specification of the product is the tensile yield strength in the pipe axial direction, the compressive yield strength in the pipe axial direction is also important in the linking parts of the pipes. From the standpoint of the fire defense and the repeated connection and detachment of the pipes for an oil well and a gas well, welding cannot be used for the linking, but fastening with threads is used. Accordingly, a compressive force in the pipe axial direction corresponding to the fastening force is generated in the thread. Therefore, the compressive yield strength in the pipe axial direction that withstands the compressive force is also important.

Furthermore, in the case where the alloy pipe receives bending deformation, a tensile stress in the axial direction occurs on the outer side of bending of the outer surface of the alloy pipe receiving the bending deformation, and simultaneously a compressive stress occurs on the inner side of bending thereof.

An alloy pipe containing a large amount of Ni has a microstructure constituted by an austenitic single phase having a low yield strength, and in the state after hot forming or heat treatment, cannot secure the tensile yield strength in the pipe axial direction required for the purposes.

Accordingly, the tensile yield strength in the pipe axial direction is enhanced through dislocation strengthening by various kinds of cold rolling. The cold rolling methods applied to an alloy pipe are limited to two methods, i.e., cold drawing rolling and cold pilger rolling, and for example, NACE (National Association of Corrosion Engineers), which is the standard relating to applications to such purposes as mining in an oil well and a gas well, defines cold drawing (cold drawing rolling) and cold pilgering (cold pilger rolling). Both the cold rolling methods are working of extending in the pipe longitudinal direction with reduction of the wall thickness and the diameter of the pipe, and therefore the dislocation strengthening due to the strain most effectively contributes to the enhancement of the tensile yield strength in the pipe longitudinal direction. It has been known that these cold rolling methods applying a strain in the pipe axis longitudinal direction cause a strong Bauschinger effect in the pipe axial direction, and thus the compressive yield strength in the pipe axial direction is decreased by approximately 20%. Accordingly, for a thread fastening part or a purpose associated with bending deformation requiring the compressive yield strength properties in the pipe axial direction, the strength design is generally performed with a low yield strength assuming the occurrence of the Bauschinger effect, and this design limits the entire product specification.

In view of the issues, PTL 1 proposes an austenitic alloy pipe that has a tensile yield strength in the pipe axial direction $YS_{LT}$ of 689.1 MPa or more, and has the tensile yield strength $YS_{LT}$, a compressive yield strength in the pipe axial direction $YS_{LC}$, a tensile yield strength in the pipe circumferential direction of the alloy pipe $YS_{CT}$, and a compressive yield strength in the pipe circumferential direction $YS_{CC}$ that satisfy the prescribed expression.

PATENT LITERATURE

PTL 1: Japanese Patent No. 5,137,048

SUMMARY OF THE INVENTION

However, PTL 1 does not consider corrosion resistance.

Aspects of the present invention have been made in view of the circumstances, and an object thereof is to provide an alloy pipe that is excellent in corrosion resistance, and has a high tensile yield strength in the pipe axial direction, and a small difference between the tensile yield strength and the compressive yield strength in the pipe axial direction, and a method for producing the same. The "small difference between the tensile yield strength and the compressive yield strength in the pipe axial direction" means that the strength ratio (compressive yield strength in the pipe axial direction)/(tensile yield strength in the pipe axial direction) is in a range of 0.85 to 1.15.

For enhancing the corrosion resistance capability of the alloy pipe, it is important that the amount of Cr and Mo, which are corrosion resistant elements, solid-dissolved in the alloy is increased, and the concentration thereof is made homogeneous. With this procedure, a high corrosion resistance capability can be exerted through the formation of a firm corrosion resistant film and the suppression of occurrence of starting points of corrosion.

Cr strengthens the passivation film to prevent the elution of the base material, thereby suppressing the weight reduction and the thickness reduction of the material. Mo is an element that is important for the suppression of pitting corrosion, which is most problematic in application of stress in a corrosive environment. It is important in the alloy pipe that these two elements are solid-dissolved in the alloy and dispersed over the alloy homogeneously, so as to prevent a portion having a less corrosion resistance capability due to a small concentration or a too large concentration of the elements, from being formed on the surface of the material.

In the alloy pipe, additionally, an intermetallic compound, an embrittled phase, and various kinds of carbides and nitrides are formed in the production through hot rolling and subsequent cooling process. These all are products containing Cr and Mo as the corrosion resistant elements. The corrosion resistant element that is in the form of these products does not contribute to the corrosion resistance capability, and generates a potential difference between the product and the adjacent sound area to accelerate corrosion due to elution of the alloy pipe through the electrochemical action, which becomes a factor decreasing the corrosion resistance capability. Accordingly, for solid-dissolving the thus formed various products in the alloy, the alloy pipe is used after subjecting to a solid solution treatment, which is a high temperature heat treatment at 1,000° C. or more, after the hot forming. Further thereafter, the dislocation strengthening is performed through cold rolling in the case where the strength is necessarily enhanced. In the case where the alloy pipe becomes a product in the state after the solid solution heat treatment or the cold rolling, the elements effective for corrosion resistance are substantially solid-dissolved in the alloy, and a high corrosion resistance capability is exerted. Accordingly, for providing a good corrosion resistance capability, it is significantly important that the product is provided while retaining the "state where the corrosion resistant elements are solid-dissolved in the alloy" obtained after the solid solution heat treatment.

As described above, for applying an alloy pipe having a high corrosion resistance capability to various purposes, the enhancement of the tensile yield strength in the pipe axial direction and the compressive yield strength in the pipe axial direction of the alloy pipe is significantly important. Furthermore, the strength properties of the thread part used for fastening are significantly important, and the strength properties of the torque shoulder part are also significantly important in a premium joint.

A high corrosion resistant alloy pipe containing a large amount of Ni contains in the structure thereof an austenitic phase having a low yield strength at ordinary temperature. Therefore, for achieving a high yield strength in addition to the high corrosion resistance capability, it is necessary to perform dislocation strengthening through cold drawing or cold pilger rolling after the solid solution heat treatment. These cold working methods can sufficiently enhance the tensile yield strength in the pipe axial direction, but the compressive yield strength in the pipe axial direction is largely decreased with respect to the tensile yield strength. Specifically, the ordinary cold drawing and the ordinary cold pilger rolling reduce the pipe wall thickness or extend the pipe in the pipe axial direction with the drawing force, and thus the yield strength in the pipe axis tensile direction is finally increased through deformation extending the alloy pipe in the pipe axial direction. On the other hand, the Bauschinger effect largely decreasing the yield strength occurs in the metal material associated with the deformation in the inverse direction to the final deformation direction. Accordingly, an alloy pipe obtained by the ordinary cold processing method has a tensile yield strength in the pipe axial direction required for an oil well and a gas well. However, since the alloy pipe has a decreased compressive yield strength in the pipe axial direction, there is a disadvantage that the alloy pipe cannot withstand the compressive stress in the pipe axial direction occurring in the thread fastening and the bending deformation thereof in the use in an oil well and a gas well or hot water mining, and undergoes plastic deformation, which leads the breakage of the passivation film deteriorating the corrosion resistance.

In view of the aforementioned facts, PTL 1 shows that a heat treatment at a low temperature is effective in the case where the decrease of the compressive yield strength due to the Bauschinger effect is necessarily suppressed. According to Example 1 of PTL 1, the heat treatment is performed at 350 to 500° C. under all the conditions for satisfying the characteristics. However, the alloy pipes of PTL 1 have a polycrystalline structure, and thus include grain boundaries where the elements can be readily diffused. Furthermore, a large amount of dislocations that are introduced to the alloy through the cold working for achieving the strength also facilitate the diffusion of the elements. Consequently, even though the heat treatment is performed at a low temperature for a short period of time, the elements are diffused thereby, resulting in a possibility that the "state where the corrosion resistant elements are solid-dissolved in the alloy" cannot be achieved.

Under the circumstances, the influence of the heat treatment at a low temperature on the corrosion resistance capability and the change of the "state where the corrosion resistant elements are solid-dissolved in the alloy" due to the low temperature heat treatment have been investigated in detail.

The present inventors prepared an austenitic alloy N08028 and a Ni based austenitic alloy N06255 specified by UNS, which were subjected, after the solution heat treatment, to cold working required for the enhancement of the strength, so as to control the tensile yield strength in the axial direction to 125 ksi or more, and alloy pipes were produced therewith. Thereafter, the alloy pipes immediately after the cold working and after subjecting to low temperature heat treatment at 350° C., 450° C., and 550° C. each were investigated for the solid solution state of the elements by a stress corrosion test and a microstructure observation. The corrosion solution used was obtained by adding $H_2S$ and $CO_2$ gases to a 25% NaCl aqueous solution containing 1,000 mg/L of sulfur under a pressure of 1.0 MPa to control the pH thereof to 2.5 to 3.5 (test temperature: 150° C.), and the stress corrosion cracking state was evaluated under application of a stress of 100% of the tensile yield stress. The microstructure observation was performed with a STEM (scanning transmission electron microscope), with which the grain boundary formed by the austenitic phase was observed, and the distributions of the precipitates and the chemical elements were quantitatively determined. As a result of the corrosion test, no corrosion occurrence was found in the test piece as cold worked state. On the other hand, in the test pieces subjected to the heat treatment in a short period of time, smudges due to cracking and corrosion on the surface of the material were observed around the grain boundary under all the conditions. The corrosion was conspicuous under the condition where the low temperature heat treatment temperature was higher. It was confirmed from the results that even through the heat treatment was performed at a low temperature, the corrosion resistance capability was adversely affected thereby.

Subsequently, the grain boundary precipitates of the austenitic phase were observed with a STEM. As a result, carbonitrides containing Cr, Mo, and W as the corrosion resistant elements bonded to C and N were confirmed in the grain boundary even in a slight amount, which shows the change in state from the "state where the corrosion resistant elements are solid-dissolved in the alloy" as cold worked state. It is considered that the carbonitride becomes a starting point of corrosion, and furthermore the consumption of the corrosion resistant elements thereby lowers the corrosion resistance capability.

Subsequently, the grain boundary surface of the austenitic phase was investigated for the quantitative distribution of the chemical elements with a STEM. As a result, the grain boundary segregation of Mo was confirmed in all the low temperature heat treatment conditions. Specifically, the segregation of Mo occurred in the grain boundary between the austenitic phase and the austenitic phase. It has been generally recognized that Mo as a substitutional element has a low diffusion rate in thermal diffusion, and undergoes substantially no diffusion particularly in a low temperature heat treatment. It was found from the present result that Mo as the corrosion resistant element was diffused even in the low temperature heat treatment, resulting in a part where the concentration thereof was locally increased. On the other hand, in the test piece under the condition as cold worked state, there was less segregation of Mo in the grain boundary of the austenitic phase, and the "state where the corrosion resistant elements are solid-dissolved in the alloy" after the solid solution heat treatment was retained.

The present inventors newly found from the aforementioned results that in the case where a large amount of dislocations were introduced through the cold working, Mo as the corrosion resistant element was diffused even in the heat treatment at a low temperature in a short period of time, resulting in a part where the concentration thereof was locally increased. The present inventors thus concluded that the locally increased concentration of Mo lowered the concentration of Mo in the vicinity thereof to form a starting point of corrosion, or generated a potential difference between the various precipitates, the intermetallic compounds, and the embrittled phases formed in the part with the increased Mo concentration and the other parts, which accelerated the elution of the alloy to dictate the deterioration of the corrosion resistance capability.

While the detailed mechanism of the segregation of Mo has not yet been clarified, some factors can be considered therefor. One of the factors is considered that Mo has been stably solid-dissolved at a high temperature condition in the austenitic phase after the solid solution heat treatment, but at ordinary temperature, is thermodynamically in an oversaturated state, and is more stable in the case where the various products are formed therewith, and a large amount of dislocations introduced in the cold working influence thereon. Specifically, in a material containing a large amount of Cr and Mo, which are the corrosion resistant elements, various embrittled phases (such as the σ phase, the X phase, the PI phase, the Laves phase, and $M_3P$) are thermodynamically stable at a temperature lower than the solid solution heat treatment temperature including the low temperature heat treatment temperature. The dislocations formed by the cold working accelerate the formation of these phases, and thus there may be a possibility that the elements are aggregated by drawing each other in the grain boundary facilitating the diffusion thereof even in the heat treatment at a low temperature.

The product of the alloy pipe requires the solid solution heat treatment before use, and the embrittled phases and the precipitates containing Mo are thermodynamically stable at the low temperature heat treatment temperature. According to these mechanisms, it is considered that for an alloy pipe containing Cr and Mo, a low temperature heat treatment lower than the solid solution heat treatment temperature causes deterioration of the corrosion resistance capability. Furthermore, it is considered that the prolongation of the retention time of the low temperature heat treatment and the increase of the temperature thereof further promote the diffusion of the elements to cause the segregation of Mo and the formation of the intermetallic compounds, resulting in adverse effects on the corrosion resistance capability.

Consequently, in the method using the low temperature heat treatment in PTL 1, the "state where the corrosion resistant elements are solid-dissolved in the alloy", which is necessary for achieving a good corrosion resistance capability, cannot be obtained, and the corrosion resistance capability required by the alloy pipe is largely deteriorated. Therefore, the technique of PTL 1 is significantly difficult to achieve simultaneously the strength properties and the corrosion resistance capability, which are required for an alloy pipe, containing a large amount of Ni, for mining in an oil well, a gas well and the geothermal energy.

Aspects of the present invention have been made based on the aforementioned knowledge, and the substance thereof includes the following.

[1] An alloy pipe containing, as a component composition, in terms of % by mass, Cr: 11.5-35.0%, Ni: 23.0-60.0%, and Mo: 0.5-17.0%, having an austenitic phase as a microstructure, having a Mo concentration (% by mass) in a grain boundary of the austenitic phase that is 4.0 times or less than a Mo concentration (% by mass) within grains of the austenitic phase, and having a tensile yield strength in a pipe axial direction of 689 MPa or more and a ratio (compressive yield strength in a pipe axial direction)/(tensile yield strength in a pipe axial direction) of 0.85 to 1.15.

[2] The alloy pipe according to the item [1], wherein the alloy pipe has a ratio (compressive yield strength in a pipe circumferential direction)/(tensile yield strength in a pipe axial direction) of 0.85 or more.

[3] The alloy pipe according to the item [1] or [2], wherein the alloy pipe contains, in addition to the component composition, in terms of % by mass, C: 0.05% or less, Si: 1.0% or less, Mn: 5.0% or less, and N: less than 0.400%, with the balance of Fe and unavoidable impurities.

[4] The alloy pipe according to any one of the items [1] to [3], wherein the alloy pipe contains, in addition to the component composition, one group or two or more groups selected from the following groups A to C:

group A: one kind or two or more kinds selected from W: 5.5% or less, Cu: 4.0% or less, V: 1.0% or less, and Nb: 1.0% or less, group B: one kind or two kinds selected from Ti: 1.5% or less and Al: 0.30% or less, group C: one kind or two or more kinds selected from B: 0.010% or less, Zr: 0.010% or less, Ca: 0.010% or less, Ta: 0.30% or less, Sb: 0.30% or less, Sn: 0.30% or less, and REM: 0.20% or less.

[5] The alloy pipe according to any one of the items [1] to [4], wherein the alloy pipe is a seamless pipe.

[6] The alloy pipe according to the item [5], wherein the alloy pipe includes a fastening part with an external thread or an internal thread at at least one end of the pipe, and the fastening part has a corner part, which is formed with a flank surface and a bottom surface of a thread root of the fastening part, having a curvature radius of 0.2 mm or more.

[7] The alloy pipe according to the item [6], wherein the fastening part further includes a metal touch sealing part and a torque shoulder part.

[8] A method for producing the alloy pipe according to any one of the items [1] to [7], the method including, after a solid solution heat treatment, performing cold bending and unbending work in a pipe circumferential direction.

[9] The method for producing the alloy pipe according to the item [8], wherein in the cold bending and unbending work in a pipe circumferential direction, a maximum achieving temperature of a worked material is 300° C. or less, and a retention time at the maximum achieving temperature is 15 minutes or less.

According to aspects of the present invention, an alloy pipe that is excellent in corrosion resistance, has a high tensile yield strength in the pipe axial direction, and a small difference between the tensile yield strength and the compressive yield strength in the pipe axial direction can be obtained. Accordingly, the alloy pipe according to aspects of the present invention can be readily applied to the use in a severe corrosive environment and the operation associated with thread fastening or bending deformation in construction in an oil well, a gas well, and a hot water well. Furthermore, the shape design of a thread fastening part or an alloy pipe structure can be readily performed.

BRIEF DESCRIPTION OF THE DRAWINGS

FIG. 1 is a schematic illustration showing the region for measuring the concentration of Mo in the alloy pipe according to aspects of the present invention.

FIG. 2 is a schematic illustration showing the bending and unbending work in the pipe circumferential direction in the method for producing an alloy pipe according to aspects of the present invention.

FIGS. 3(*a*) and 3(*b*) are cross sectional views in the pipe axial direction (i.e., cross sectional views in parallel to the pipe axial direction) showing a part of the thread fastening part of the external thread and the internal thread in the alloy pipe according to aspects of the present invention, in which FIG. 3(*a*) is a schematic illustration showing one example of the case where the thread shape is a trapezoidal thread, and FIG. 3(*b*) is a schematic illustration showing one example of the case where the thread shape is a triangular thread.

FIGS. 4(*a*) and 4(*b*) are cross sectional views in the pipe axial direction (i.e., cross sectional views in parallel to the pipe axial direction) showing the thread joint, in which FIG. 4(*a*) is a schematic illustration showing the case where the thread joint is an API thread joint, and FIG. 4(*b*) is a schematic illustration showing the case where the thread joint is a premium joint.

FIG. 5 is a schematic illustration of the vicinity of the nose part, which is an extension part of the pin of the thread joint in accordance with aspects of the present invention.

DETAILED DESCRIPTION OF EMBODIMENTS OF THE INVENTION

Embodiments of the present invention will be described below. Unless otherwise indicated, percentage by mass is simply shown as "%".

The alloy pipe according to aspects of the present invention contains, as a component composition, in terms of % by mass Cr: 11.5-35.0%, Ni: 23.0-60.0%, and Mo: 0.5-17.0%, has an austenitic phase as a microstructure, and has a Mo concentration (% by mass) in the grain boundary of the austenitic phase that is 4.0 times or less than the Mo concentration (% by mass) within the grains of the austenitic phase.

Ni is an element that stabilizes the austenitic phase and is necessary for providing the stable austenitic single phase important for the corrosion resistance. Cr is necessary for strengthening the passivation film to prevent the material from being eluted, so as to suppress the weight reduction of the alloy pipe and the reduction of the wall thickness thereof. On the other hand, Mo is an element that is necessary for suppressing the pitting corrosion, which is most problematic in application of stress in a corrosive environment. In the alloy pipe according to aspects of the present invention, Cr and Mo are solid-dissolved in the alloy, and these elements are dispersed over the alloy homogeneously. It is important to suppress, with this procedure, the decrease of the corrosion resistance capability caused by the occurrence of the part having a less concentration of the elements on the surface of the material or by the excessive increase of the concentration of Mo due to the formation of the embrittled phase thereon.

Cr: 11.5-35.0%

Cr is the most important element that strengthens the passivation film of the steel to enhance the corrosion resistance capability. For providing the corrosion resistance capability as the alloy pipe, a Cr amount of 11.5% or more is necessary. The increase of the Cr amount is the most basic factor stabilizing the passivation film, and the passivation film is further strengthened by increasing the Cr concentration. Accordingly, the increase of the Cr amount contributes to the enhancement of the corrosion resistance. However, a Cr content exceeding 35.0% causes precipitation of an embrittled phase during the process of solidifying the molten alloy material and during the hot forming, and cracks are formed over the entire alloy after the solidification, so that the forming of the product (alloy pipe) becomes difficult. Accordingly, the upper limit of the Cr amount is 35.0%. Therefore, the Cr amount is 35.0% or less. From the standpoint of the simultaneous achievement of the corrosion resistance required for the alloy pipe and the productivity thereof, the Cr amount is preferably 24.0% or more and is preferably 29.0% or less.

Ni: 23.0-60.0%

Ni is an element that is important for making the microstructure into an austenitic single phase. Ni that is added in an appropriate amount with respect to the other essential elements makes the microstructure into an austenitic single phase, so as to exert a high corrosion resistance capability against stress corrosion cracking. The Ni amount is necessarily 23.0% or more for making the microstructure into an austenitic phase. While the upper limit of Ni may be determined in relation to the amounts of the other alloy elements, a too large amount of Ni added increases the alloy cost. Accordingly, the upper limit of the Ni amount is 60.0%. Therefore, the Ni amount is 60.0% or less. In relation to the corrosion resistance capability required for the alloy pipe and the cost thereof, the Ni amount is preferably 24.0% or more and is preferably 60.0% or less, and more preferably 38.0% or less.

Mo: 0.5-17.0%

Mo is an element that is important for enhancing the pitting corrosion resistance of the steel corresponding to the content thereof. Accordingly, it is necessary that the element is distributed homogeneously over the surface of the alloy material to be exposed in a corrosive environment. On the other hand, an excessive amount of Mo contained precipitates an embrittled phase from the molten steel during solidification to cause a large amount of cracking in the solidified structure, which largely impair the subsequent forming stability. Accordingly, the upper limit of Mo is 17.0%. Therefore, the Mo amount is 17.0% or less. While Mo contained enhances the pitting corrosion resistance corresponding to the content thereof, 0.5% or more of Mo is necessarily contained for retaining the stable corrosion resistance in a sulfide environment. From the standpoint of the simultaneous achievement of the corrosion resistance required for the alloy pipe and the stable productivity thereof, the Mo amount is preferably 2.5% or more and is preferably 7.0% or less.

Austenitic Phase Structure The alloy pipe microstructure according to aspects of the present invention, which is important for the stress corrosion cracking resistance, will be then described. For providing the stress corrosion cracking resistance under a sulfide environment, the microstructure in the alloy pipe is necessarily an austenitic phase. Since aspects of the present invention relate to an alloy pipe that is used in a purpose requiring the corrosion resistance capability in an environment with stress occurring, it is important to make a suitable austenitic single phase. The "suitable austenitic single phase" referred in accordance with aspects of the present invention means a material microstructure state that is constituted only by an austenitic phase having a face-centered cubic lattice containing no other phase, such as the δ-ferrite phase, the σ-phase, the χ-phase, and the Laves phase. The fine precipitate that is not thermodynamically solid-dissolved in the alloy at the temperature of the solid solution heat treatment described later, such as carbonitrides and oxides of Al, Ti, Nb, and V, and inclusions unavoidably contained are excluded from the consideration.

Mo Concentration (% by mass) in Grain Boundary of Austenitic Phase of 4.0 times or less than Mo Concentration (% by mass) within Grains of Austenitic Phase The segregation of Mo occurs in the grain boundary of the austenitic phase of the alloy pipe structure subjected to the low temperature heat treatment. In accordance with aspects of the present invention, for providing the good corrosion resistance capability, it is necessary that the Mo concentration (% by mass) in the grain boundary of the austenitic phase is 4.0 times or less than the Mo concentration (% by mass) within the grains of the austenitic phase. In the case where the proportion of the Mo concentration in the grain boundary of the austenitic phase is 4.0 times or less than the Mo concentration within the grains of the austenitic phase, the formation of the part having an extremely small Mo content in the alloy can be avoided. Furthermore, the formation of the embrittled phase formed with the part having an excessively large Mo content in the alloy can be suppressed. As a result, the corrosion resistance capability can be retained to a favorable state. The proportion that is 2.5 times or less can further enhance the corrosion resistance capability. For stably providing the excellent corrosion resistance capability in consideration of uneven concentration distribution of the element, the proportion is preferably 0.8 time or more and is preferably 2.0 times or less.

The measurement method of the Mo concentration will be described herein with reference to FIG. 1. FIG. 1 shows one example the region for measuring the concentration of Mo in the alloy pipe structure.

The Mo concentration may be measured, for example, with a STEM. Since the Mo concentration in the vicinity of the grain boundary of the austenitic phase is not stable, it suffices that in the calculation of the Mo concentration within the grains of the austenitic phase, the Mo concentration is calculated after excluding the data of the region of 0 to 50 nm from the edge of the grain boundary.

In the example shown in FIG. 1, the measurement region of the Mo concentration within the grains has a range in the transverse direction of the measurement region of 100 to 200 nm from the edge of the grain boundary toward the inner grain. As shown in FIG. 1, the direction perpendicular to the grain boundary corresponds to the "transverse direction of the measurement region". Assuming that the range is the transverse direction of the measurement region, the size of the region in the longitudinal direction of the measurement direction is not particularly limited. As shown in FIG. 1, the direction in parallel to the grain boundary corresponds to the "longitudinal direction of the measurement region". The size of the measurement region (in both the longitudinal direction and the transverse direction) is not particularly limited, and may be set to be an appropriate range.

The measurement region (i.e., the hatched rectangular area in FIG. 1) is measured for the Mo concentration with a constant interval. There are various methods for quantitative determination of the concentration, and examples thereof include a method of counting the percentage by mass in the alloy. In the case where this method is used, it suffices that the value obtained by dividing the maximum value (peak value) of the percentage by mass of Mo on the grain boundary of the austenitic phase by the average value of the percentage by mass of Mo within the grain of the austenitic phase (peak value/average value) is defined as the Mo segregation amount and calculated. The segregation amount of Mo can be confirmed not only with a STEM, but also by elemental analysis of Mo with a scanning electron microscope or a transmission electron microscope.

The grain boundary in accordance with aspects of the present invention is assumed to be a crystal orientation angle of 15° or more. The crystal orientation angle may be confirmed with a STEM or a TEM. The crystal orientation angle may also be readily confirmed through the crystal orientation analysis by the EBSD method (electron backscatter diffraction method).

The alloy pipe according to aspects of the present invention preferably contains, in addition to the component composition, in terms of % by mass C: 0.05% or less, Si: 1.0% or less, Mn: 5.0% or less, and N: less than 0.400%.

C: 0.05% or Less

C deteriorates the corrosion resistance. Accordingly, for providing the suitable corrosion resistance capability, the upper limit of C is preferably restricted to 0.05%. Therefore, the C amount is preferably 0.05% or less. While the lower limit of C may not be necessarily determined, a too small C amount may increase the decarburization cost in melting. Accordingly, the C amount is preferably 0.005% or more.

Si: 1.0% or Less

A large amount of Si remaining in the alloy may impair the workability. Accordingly, the upper limit of Si is preferably 1.0%. Therefore, the Si amount is preferably 1.0% or less. Since Si has a deoxidation function of a steel, and thus a suitable amount thereof contained in the molten alloy is effective, the Si amount is preferably 0.01% or more. From the standpoint of the simultaneous achievement of the sufficient deoxidation function and the suppression of the adverse effect thereof excessively remaining in the alloy, the Si amount is more preferably 0.2% or more and is preferably 0.8% or less.

Mn: 5.0% or Less

An excessive amount of Mn contained decreases the hot workability. Accordingly, the Mn amount is preferably 5.0% or less. Mn is a strong austenitic phase forming element, and is more inexpensive than the other austenitic phase forming elements. Furthermore, Mn is effective for making S harmless, which is an impurity element mixed in the molten alloy, and the addition thereof in a slight amount has an effect of fixing S as MnS. Accordingly, Mn is preferably contained in an amount of 0.01% or more. On the other hand, in the case where there is a demand of the full utilization of Mn as the austenitic phase forming element from the standpoint of the cost reduction, the Mn amount is more preferably 2.0% or more and is more preferably 4.0% or less.

N: Less than 0.400%

N is inexpensive by itself, but addition of an excessive amount of N requires a special equipment and an addition time, which lead the increase of the production cost. Accordingly, the N amount is preferably less than 0.400%. N is a strong austenitic phase forming element, and is inexpensive. When N is solid-dissolved in the alloy, it is effective for the enhancement of the strength after cold working. However, addition of a too large amount of N causes a problem of the formation of bubbles in the alloy. A too small amount of N on the other hand causes a problem of a high vacuum degree required in melting and refining. In view of the factors, the N amount is preferably 0.010% or more and is more preferably 0.350% or less. The N amount is more preferably 0.10% or more and is further preferably 0.25% or less.

The alloy pipe according to aspects of the present invention may appropriately contain, in addition to the aforementioned elements, the following elements.

One Kind or Two or more Kinds selected from W: 5.5% or less,

Cu: 4.0% or less, V: 1.0% or less, and Nb: 1.0% or less

W: 5.5% or Less

W enhances the pitting corrosion resistance as similar to Mo, but an excessive amount thereof contained impairs the workability in hot working and thus impairs the production stability. Accordingly, in the case where W is contained, the upper limit thereof is 5.5%. Therefore, the W amount is preferably 5.5% or less. The lower limit of W contained may not be necessarily determined, and in view of the factor of stabilizing the corrosion resistance capability of the alloy pipe, W is preferably contained in an amount of 0.1% or more. From the standpoint of the corrosion resistance required for the alloy pipe and the production stability, the W amount is more preferably 1.0% or more and is more preferably 5.0% or less.

Cu: 4.0% or Less

Cu is an austenitic phase forming element, and simultaneously enhances the corrosion resistance. Accordingly, this element can be positively used in the case where the corrosion resistance becomes insufficient with Mn and Ni as the other austenitic phase forming elements. On the other hand, a too large amount of Cu contained leads to the deterioration of the hot workability, which makes the forming difficult. Accordingly, in the case where Cu is contained, the Cu amount is preferably 4.0% or less. While the lower limit of the Cu amount may not be necessarily determined, Cu contained in an amount of 0.1% or more can provide the corrosion resistance effect. From the standpoint of the simultaneous achievement of the enhancement of the corrosion resistance and the hot workability, the Cu amount is more preferably 0.5% or more and is more preferably 2.5% or less.

V: 1.0% or Less

An excessive amount of V added impairs the hot workability, and therefore in the case where V is contained, the V amount is preferably 1.0% or less. The addition of V is effective for the enhancement of the strength, thereby providing a product with high strength. Furthermore, the cold working performed for achieving the product strength can be reduced. The strength enhancement effect can be obtained by the addition of V in an amount of 0.01% or more. Accordingly, in the case where V is contained, the amount thereof is preferably 0.01% or more. Since V is an expensive element, from the standpoint of the strength enhancement effect obtained through the addition thereof and the cost, the V amount is more preferably 0.05% or more and is more preferably 0.40% or less.

Nb: 1.0% or Less

An excessive amount of Nb added impairs the hot workability, and therefore in the case where Nb is contained, the Nb amount is preferably 1.0% or less. The addition of Nb is effective for the enhancement of the strength, thereby providing a product with high strength. Furthermore, the cold working performed for achieving the product strength can be reduced. The strength enhancement effect can be obtained by the addition of Nb in an amount of 0.01% or more. Accordingly, in the case where Nb is contained, the Nb amount thereof is preferably 0.01% or more. Since Nb is an expensive element as similar to V, from the standpoint of the strength enhancement effect obtained through the addition thereof and the cost, the Nb amount is more preferably 0.05% or more and is more preferably 0.40% or less.

In the case where both V and Nb are contained, a total content of V and Nb of 0.06 to 0.50% can further stabilize the strength enhancement effect.

One Kind or Two Kinds selected from Ti: 1.5% or less and Al: 0.30% or less

Ti: 1.5% or less

Ti forms a fine carbide, and makes C harmless which is harmful for the corrosion resistance capability and simultaneously enhances the strength through the formation of a fine nitride. This effect can be obtained with a Ti amount of 0.0001% or more. An increased amount of Ti decreases the low temperature toughness of the alloy pipe, and in the case where Ti is contained, the Ti amount is preferably 1.5% or less. The Ti amount is more preferably 0.0003% or more and is more preferably 0.50% or less.

Al: 0.30% or Less

The addition of Al is effective as a deoxidizing agent in refining. For providing the effect, in the case where Al is contained, the Al amount may be 0.01% or more. A large amount Al remaining in the alloy pipe impairs the low temperature toughness and adversely affects the corrosion resistance capability. Accordingly, in the case where Al is contained, the Al amount is preferably 0.30% or less.

One Kind or Two or more Kinds selected from B: 0.010% or less, Zr: 0.010% or less, Ca: 0.010% or less, Ta: 0.30% or less, Sb: 0.30% or less, Sn: 0.30% or less, and REM: 0.20% or less In the case where the addition amounts of B, Zr, Ca, and REM (rare earth metals) are too large, the hot workability is deteriorated, and simultaneously the alloy cost is increased due to the rare elements. Accordingly, the upper limit of the amount thereof added is preferably 0.010% for each of B, Zr, and Ca, and preferably 0.20% for REM. Therefore, in the case where B, Zr, and Ca are contained, the amounts thereof each are preferably 0.010% or less, and in the case where REM is contained, the REM amount is preferably 0.20% or less. B, Zr, Ca, and REM added in slight amounts enhance the bonding force in the grain boundary and alter the forms of the oxides on the surface of the alloy material, so as to enhance the hot workability and the formability. An alloy pipe is generally a difficult-to-form material, and thus often causes rolling marks and shape defect due to the work amount and the processing mode, and these elements contained are effective in the case where the forming condition causes these problems. The lower limits of the amounts of B, Zr, Ca, and REM may not be necessarily determined. In the case where B, Zr, Ca, and REM are contained, the effect of the enhancement of the workability and the formability can be obtained in the case where the amounts thereof each are 0.0001% or more. While REM includes plural kinds of elements, the amount thereof added is the total amount.

A too large amount of Ta added increases the alloy cost, and therefore in the case where Ta is contained, the upper limit thereof is preferably 0.30%. Therefore, in the case where Ta is contained, the Ta amount is preferably 0.30% or less. Ta added in a small amount suppresses the transformation to the embrittled phase and enhances the hot workability and the corrosion resistance simultaneously. Furthermore, Ta is effective in the case where the alloy pipe is retained in a temperature range where the embrittled phase is stable for a long period of time in hot working and subsequent cooling. Therefore, in the case where Ta is contained, the Ta amount is preferably 0.0001% or more.

Too large amounts of Sb and Sn decrease the formability. Accordingly, in the case where Sb and Sn are contained, the upper limits thereof each are preferably 0.30%. Therefore, in the case where Sb and Sn are contained, the amounts thereof each are preferably 0.30% or less. Sb and Sn added in small amounts enhance the corrosion resistance. Therefore, in the case where Sb and Sn are added, the amounts thereof each are preferably 0.0003% or more.

The balance except for the aforementioned elements is Fe and unavoidable impurities.

The alloy pipe according to aspects of the present invention has a tensile yield strength in the pipe axial direction of 689 MPa or more.

In general, an alloy pipe containing a large amount of Ni contains a soft austenitic phase in the microstructure thereof, and therefore the tensile yield strength in the pipe axial direction thereof does not reach 689 MPa in the state after the solid solution heat treatment. In accordance with aspects of the present invention, however, a tensile yield strength in the pipe axial direction of 689 MPa or more can be obtained through the dislocation strengthening by the aforementioned cold working (i.e., the bending and unbending work in the pipe circumferential direction).

With a higher tensile yield strength in the pipe axial direction, the pipe can be designed with a lower wall thickness, which is more advantageous in cost. However, in the case where only the wall thickness is reduced with the constant outer diameter of the pipe, the pipe becomes less resistant to the collapse due to the external pressure in mining and the inner pressure of the inner fluid, and thus cannot be applied to an alloy pipe for an oil well and the like. Due to the factor, a pipe having a tensile yield strength in the pipe axial direction in a range of 1,033.5 MPa or less is frequently used.

The alloy pipe according to aspects of the present invention has a ratio of the compressive yield strength in the pipe axial direction and the tensile yield strength in the pipe axial direction, i.e., a strength ratio (compressive yield strength in the pipe axial direction)/(tensile yield strength in the pipe axial direction), of 0.85 to 1.15.

In the case where the strength ratio (compressive yield strength in the pipe axial direction)/(tensile yield strength in the pipe axial direction) is 0.85 to 1.15, the alloy pipe can withstand a higher compressive stress in the pipe axial direction occurring in thread fastening or inflecting the alloy pipe, and thereby the alloy pipe according to aspects of the present invention can be applied to an environment, to which the ordinary pipes cannot be applied due to the shortage of the compressive stress resistance. Furthermore, the large wall thickness of the pipe, which is necessary for the low compressive yield strength, can be reduced. Moreover, the construction management in thread fastening and bending where a compressive force occurs can be readily managed.

In accordance with aspects of the present invention, in addition to the aforementioned characteristics, the alloy pipe preferably has a ratio of the compressive yield strength in the pipe circumferential direction and the tensile yield strength in the pipe axial direction, i.e., the strength ratio (compressive yield strength in the pipe circumferential direction)/(tensile yield strength in the pipe axial direction), of 0.85 or more.

For example, with the same wall thickness of pipes, the depth of the well minable therewith depends on the tensile yield strength in the pipe axial direction. Accordingly, for preventing the alloy pipe from being collapsed by the external pressure occurring in a well having a large depth, the strength ratio of the compressive yield strength in the pipe circumferential direction with respect to the tensile yield strength in the pipe axial direction is preferably 0.85 or more. The case where the compressive yield strength in the pipe circumferential direction is larger than the tensile yield strength in the pipe axial direction causes no particular problem, and the strength ratio is generally saturated at approximately 1.50 at most. In the case where the strength ratio is too large, on the other hand, the other mechanical properties may be affected, for example, in focusing on the low temperature toughness, and the low temperature toughness in the pipe circumferential direction is largely decreased with respect to the low temperature toughness in the pipe axial direction. Accordingly, the strength ratio (compressive yield strength in the pipe circumferential direction)/(tensile yield strength in the pipe axial direction) is more preferably in a range of 0.85 to 1.25.

In accordance with aspects of the present invention, in addition to the aforementioned microstructure of the alloy pipe, it is preferred that the aspect ratio of an austenite grain separated at a difference in crystal orientation angle of 15° or more on the thickness cross section in the pipe axial direction is 9 or less. It is also preferred that the austenite grains having an aspect ratio of 9 or less occupy 50% or more of the entire microstructure in terms of area fraction.

The alloy pipe according to aspects of the present invention is controlled to have a recrystallized austenitic microstructure having plural crystal grains separated at a crystal orientation angle of 15° or more through the solid solution heat treatment. As a result, the aspect ratio of the austenite grain becomes small. The alloy pipe in this state has a low tensile yield strength in the pipe axial direction, but has a strength ratio (compressive yield strength in the pipe axial direction)/(tensile yield strength in the pipe axial direction) being close to 1. Thereafter, for enhancing the tensile yield strength in the pipe axial direction, the ordinary practice is that the alloy pipe is subjected to drawing (such as cold drawing rolling or cold pilger rolling) in the pipe axial direction. According to the procedure, the strength ratio (compressive yield strength in the pipe axial direction)/(tensile yield strength in the pipe axial direction) and the aspect ratio of the austenite grain are changed.

Accordingly, the aspect ratio of the austenite grain and the strength ratio (compressive yield strength in the pipe axial direction)/(tensile yield strength in the pipe axial direction) are closely related to each other. Specifically, in the aforementioned cold rolling, the yield strength is enhanced in the direction in which the austenite grain is drawn, after the working. On the other hand, the yield strength is decreased in the inverse direction (i.e., the direction inverse to the drawing direction above) through the Bauschinger effect, resulting in increase of the difference between the compressive yield strength in the pipe axial direction and the tensile yield strength in the pipe axial direction. It has been found from these that in the case where the cold working is selected to control the aspect ratio of the austenite grains after the working to a small value, an alloy pipe that has a small strength anisotropy in the pipe axial direction and is excellent in strength characteristics of the thread part can be obtained as a result.

Accordingly, in accordance with aspects of the present invention, in the case where the aspect ratio of the austenite grain is 9 or less, an alloy pipe having a less strength anisotropy can be stably obtained. In the case where the austenite grains having an aspect ratio of 9 or less occupy 50% or more of the entire microstructure in terms of area fraction, an alloy pipe having a less strength anisotropy can be stably obtained. In the case where the aspect ratio is 5 or less, an alloy pipe having a less strength anisotropy can be more stably obtained. Since the strength anisotropy can be further decreased by decreasing the aspect ratio, the lower limit thereof is not particularly limited, and the aspect ratio is preferably close to 1 as far as possible.

The aspect ratio of the austenite grain may be obtained in the following manner. For example, a grain having a crystal orientation angle of 150 or more in the austenitic phase is observed by the crystal orientation analysis on the cross section in the pipe axial direction, and the aspect ratio is obtained from the ratio of the long side and the short side (short side/long side) of the rectangle that encompasses the grain in the frame thereof. An austenite grain having a small grain diameter involves a large error, and there is a possibility that an error occurs in the aspect ratio in the case where an austenite grain having a small grain diameter is included. Accordingly, as for the austenite grain to be measured for the aspect ratio, a grain with 10 μm or more in terms of the diameter of the true circle having the same area as the area of the measured grain is preferably targeted.

For stably providing the structure having a small aspect ratio of the austenite grain on the cross section in the pipe axial direction, bending and unbending work in the pipe circumferential direction may be used. The bending and unbending work in the pipe circumferential direction is not associated with deformation of the austenite grain through wall thickness reduction and drawing, and thus cold working can be performed without change in aspect ratio. The strength anisotropy can be further reduced by controlling the austenite grains having an aspect ratio of 9 or less to have an area fraction of 50% or more.

A thread joint using the alloy pipe according to aspects of the present invention will be then described with reference to FIGS. 3(A) to 5.

The thread joint is constituted by a pin 1 having an external thread and a box 2 having an internal thread. Examples of the thread joint include a standard thread joint defined by API (American Petroleum Institute) Standard shown in FIG. 4(*a*) and a high performance special thread joint referred to as a premium joint having a metal touch sealing part and a torque shoulder part in addition to the thread parts as shown in FIG. 4(*b*).

For achieving firm fastening of the thread parts, the ordinary practice is that the thread parts are designed to generate a contact surface pressure in the diameter direction, and for example, a taper thread is used. The pin 1 (external thread) is deformed to reduce the diameter and is extended in the pipe axial direction, and the box 2 (internal thread) is deformed to increase the diameter and is contracted in the pipe axial direction, with the surface pressure in the diameter direction, and thus a contact surface pressure is generated at the flank surface at the ends of the threads. Accordingly, the threads receive the compressive stress in the pipe axial direction corresponding to the fastening force. Therefore, it is important to achieve a compressive yield strength in the pipe axial direction that withstands the compressive stress. In the premium joint, a large compressive stress in the pipe axial direction is generated at the torque shoulder part 3, and therefore a material that has a high compressive yield strength in the pipe axial direction is important for preventing the plastic deformation of the torque shoulder part 3.

The alloy pipe according to aspects of the present invention has the excellent compression resistance as described above, and thereby can be used as a thread joint that is directly connected to another alloy pipe (integral type) and a thread joint that is connected through a coupling 12 (T&C type) In the fastening part of the thread, tensile and compressive stresses in the pipe axial direction are generated through fastening and bending deformation after fastening. Therefore, the use of the alloy pipe according to aspects of the present invention as the thread joint can achieve a thread joint capable of retaining the high corrosion resistance capability and the high thread joint performance.

FIGS. 3(*a*) and 3(*b*) are cross sectional views in the pipe axial direction (i.e., cross sectional views in parallel to the pipe axial direction) showing the thread fastening part of the external thread 6 and the internal thread 7, and are schematic illustrations showing the position of the curvature radius R of the corner part 9. FIG. 3(*a*) shows one example for describing the case of a trapezoidal thread, and FIG. 3(*b*) shows one example for describing the case of a triangular thread. In accordance with aspects of the present invention, it is preferred that the alloy pipe includes a fastening part with an external thread 6 or an internal thread 7 at at least one end of the pipe, and the fastening part has a corner part 9, which is formed with a flank surface 8 and a bottom surface of a thread root of the fastening part, having a curvature radius of 0.2 mm or more.

In accordance with aspects of the present invention, accordingly, irrespective of the type of the thread, the external thread 6 and the internal thread 7 are in contact with each other in fastening, and the curvature radius R of the corner part 9, which is formed with the flank surface 8 receiving the pressure in fastening and the bottom surface of the thread root, may be 0.2 mm or more. According to the configuration, the stress concentration occurring at the corner part 9 having the curvature radius R can be relieved, and as a result, the fatigue properties can be enhanced while retaining the high corrosion resistance capability.

As for the flank surface 8, in the external thread 6 (i.e., the pin 1), the slope of the thread on the side close to the pipe end is referred to as a stabbing flank surface 10*a*, and the slope of the thread thereof on the side far from the pipe end is referred to as a load flank surface 10*b*. In the internal thread 7 (i.e., the box 2), the slope of the thread facing the stabbing flank 10*a* of the pin 1 is referred to as a stabbing flank surface 11*a*, and the slope of the thread facing the load flank surface 10*b* of the pin 1 is referred to as a load flank surface 11*b*. In FIG. 3(*a*), the symbols show as follows: 9*a*: the curvature radius of the corner part on the side of the load flank surface of the box; 9*b*: the curvature radius of the corner part on the side of the stabbing flank surface of the box; 9*c*: the curvature radius of the corner part on the side of the load flank surface of the pin; and 9*d*: the curvature radius of the corner part on the side of the stabbing flank surface of the pin. In FIG. 3(*b*), the symbol 9 shows the curvature radius of the corner part of the pin and the box.

FIGS. 4(*a*) and 4(*b*) are cross sectional views in the pipe axial direction (i.e., cross sectional views in parallel to the pipe axial direction) showing the thread joint. FIG. 4(*a*) shows an API thread joint, and FIG. 4(*b*) shows a premium joint. In FIGS. 4(*a*) and 4(*b*), the symbol 1 shows the pin, and the symbol 12 shows the coupling. In FIG. 4(*b*), the symbol 3 shows the torque shoulder part, the symbol 4 shows the metal touch sealing part, and the symbol 5 shows the thread part.

As shown in FIG. 4(*a*), in the case of a thread joint constituted only by a thread part, as in an API thread joint, in fastening the thread, the maximum surface pressure is generated at the both ends of the thread part, and the thread part on the side of the top end of the pin 1 is in contact at the stabbing flank surface, whereas the thread part on the side of the back end of the pin 1 is in contact at the load flank surface. As shown in FIG. 4 (*b*), in the case of a premium joint, it is necessary to consider the reaction force by the torque shoulder part 3, and in fastening the thread, the maximum surface pressure is generated at the load flank surfaces at the both ends of the thread part 5.

In the ordinary technique, the compressive yield strength in the pipe axial direction is low with respect to the tensile yield strength in the pipe axial direction due to the influence of the Bauschinger effect in the pipe axial direction, and in the case where compression stress occurs at the stress concentration part, microscopic deformation readily occurs due to the low compressive yield strength, resulting in the deterioration of the fatigue life. A method of performing a low temperature heat treatment for reducing the Bauschinger effect has also been known, but the low temperature heat treatment negates the "state where the corrosion resistant elements are solid-dissolved" to fail to provide a high corrosion resistance capability, resulting in failure of simultaneous achievement of the corrosion resistance and the enhancement of the fatigue properties of the thread part.

According to aspects of the present invention, by setting the curvature radius R of the corner part 9 to 0.2 mm or more, the fatigue properties of the thread part of the alloy pipe can be enhanced, and a good corrosion resistance capability can be obtained.

The increase of the curvature radius R of the corner part 9 to 0.2 mm or more is effective for relieving the further stress concentration. However, the large curvature radius R of the corner part 9 may impair the degree of freedom in designing the thread part, resulting in a possibility of the restriction in size of the alloy pipe capable of being processed to have a thread, and the impossibility in designing. Furthermore, in the case where the curvature radius R of the corner part 9 is increased, the area of the flank surfaces of the external thread and the internal thread in contact with each other is decreased, resulting in decrease of the sealability and the fastening force. Accordingly, the curvature radius R of the corner part 9 is preferably in a range of 0.2 to 3.0 mm. It is appropriate that the area of the flank surface that is decreased due to the size of the curvature radius R of the corner part 9 is defined in relation to the height of the thread. Accordingly, it is preferred that the curvature radius R is such a value that the corner part 9 occupies a length in the radial direction (i.e., a length in the direction from the pipe axial center in the diametrical direction) of less than 20% of the height of the thread, and simultaneously the curvature radius R of the corner part 9 is 0.2 mm or more.

FIG. 4(*b*) is a schematic illustration of a premium joint equipped with a metal touch sealing part 4 and a torque shoulder part 3 in addition to a thread part 5. The metal touch sealing part 4 shown in FIG. 4(*b*) secures the sealability of the fastened pipes. The torque shoulder part 3 functions as a stopper in fastening and thus has an important role of securing the fastening position, but receives high compressive stress in fastening. The deformation of the torque shoulder part 3 due to the high compressive stress impairs the high sealability and decreases the inner diameter due to the deformation toward the inside to cause a problem. Accordingly, there occurs a necessity of increasing the wall thickness for preventing the torque shoulder part 3 from being deformed, so as to enhance the compressive strength thereof, and thus a thin alloy pipe cannot be designed. In alternative, the too large wall thickness causes material loss.

Furthermore, in general, threads are fastened in such a manner that the fastening torque value is confirmed from the sealing torque value to the torque value that does not deform the torque shoulder part, and then managed within a range of from the sealing torque value to the torque value that does not deform the torque shoulder part 3. The "fastening torque value" herein means the torque value during fastening the threads. The "sealing torque value" herein means the torque value during fastening where the torque value shows a sealed state after exceeding a certain standard through fastening. The tip of the thread is deformed in the case where the torque value exceeds a certain standard, and therefore the "torque value that does not deform the torque shoulder part" herein means a torque value that does not exceed the standard.

At this time, in the case where the compressive yield strength in the pipe axial direction of the pipe is small, the upper limit of the torque value preventing the torque shoulder part 3 from being deformed becomes small. Accordingly, the range for managing the torque value is narrowed to fail to fasten threads stably. According to aspects of the present invention excellent in the compressive yield strength in the pipe axial direction of the pipe, the deformation of the torque shoulder part 3 can be prevented while retaining the high corrosion resistance capability.

For stably fastening threads while preventing the torque shoulder part 3 from being deformed, the cross sectional area of the tip thickness as the torque shoulder part 3 of the external thread shown in FIG. 5 is secured to be 25% or more of the cross sectional area of the original pipe. The "tip thickness as the torque shoulder part" herein is a part of the tip of the external thread where the coupling receives the thread, and is a value expressed by (Ds1−Ds0)/2.

In the case where the tip thickness as the torque shoulder part 3 is increased, the nose stiffness becomes too high to cause a problem of occurrence of seizing in fastening. Accordingly, the tip thickness is preferably in a range of 25 to 60%. The nose part is preferably designed to increase the compression resistance strength of the torque shoulder part 3, thereby achieving a high torque capability. The "high torque capability" herein means that the torque value that does not cause deformation is increased, and thereby a higher fastening torque can be applied.

FIG. 5 shows a schematic illustration of the vicinity of the nose part including a cut cross sectional view of the pin 1 and the coupling 12 in parallel to the pipe axial direction (see (a) in FIG. 5) and the torque shoulder part 3 viewed from the front of the tip of the pin at the tip of the thread of the pin 1 (see (b) in FIG. 5).

As shown in FIG. 5, for achieving the high torque capability, it is preferred that assuming that the sealing point position from the pipe end is x, the ratio (x/L) of x with respect to the length L of the nose, which is a part without thread at the tip of the pin, is 0.01 or more and 0.1 or less.

By providing the sealing point position in the vicinity of the shoulder part, the substantial cross sectional area of the shoulder part (cross sectional area of shoulder part: $\pi/4\times(Ds1^2-Ds0^2)$) is increased to provide the high torque capability. At this time, in the case where the nose length L is too large, the nose stiffness is lowered to fail to withstand a high compressive force, and therefore the nose length L is preferably 0.5 inch or less. In the case where the nose length L is too small, on the other hand, there is no margin for providing the sealing part, and therefore the nose length L is preferably 0.2 inch or more.

In FIG. 5, the symbols mean as follows:

δ: the seal interference amount defined by the maximum value of the overlap amount when the drawings are overlapped, Ds1: the outer diameter of the shoulder contact region, and Ds0: the inner diameter of the shoulder contact region.

The high torque capability cannot be achieved by the ordinary stainless steels having a low compressive yield strength in the pipe axial direction.

The sealability exhibiting gas tightness is also an important factor of the characteristics of the thread pat, and it is preferred to satisfy a compression ratio of 85% or more shown in the sealing test of ISO 13679:2019. For achieving the high sealability, it is preferred that the length L of the nose, which is a part without thread at the tip of the pin, is 0.3 inch or more, and the ratio x/L is 0.2 or more and 0.5 or less. However, in the case where the nose length L is unnecessarily too large, the cutting thereof requires a prolonged period of time, and the nose stiffness is lowered to make the performance unstable. Therefore, the nose length L is preferably 1.0 inch or less.

The design with a long nose length has been impossible with the ordinary alloy pipe having a low compressive yield strength since the alloy pipe inevitably cannot withstand the design with a thin nose tip.

In accordance with aspects of the present invention, the alloy pipe is preferably a seamless alloy pipe (seamless pipe) having no welding in the pipe circumferential direction from the standpoint of the homogeneity of the material in the pipe circumferential direction.

The method for producing the alloy pipe according to aspects of the present invention will be then described.

A material having a composition becoming the aforementioned austenitic single phase is produced. Various melting methods may be applied to the melting with no limitation. For example, in the case where bulks and scraps of the elements are melted with an electric furnace to produce the material, a vacuum melting furnace or an atmospheric melting furnace may be used. The molten material is solidified through stationary casting or continuous casting to provide an ingot or a slab, which is then formed through hot rolling or forging to provide the material.

Subsequently, the material is heated in a heating furnace and formed into an alloy pipe shape through various hot rolling processes. For example, in the case where a seamless alloy pipe (seamless pipe) is produced, the material in the form of a round billet is subjected to a hot forming (piercing process) to form into a hollow pipe. The hot forming used may be any of the Mannesmann method, the extrusion pipe making method, and the like. Depending on necessity, a hot pilger, an elongater, an Assel mill, a mandrel mill, a plug mill, a sizer, a stretch reducer, and the like, which are hot rolling processes performing the wall thickness reduction and the sizing of the outer diameter of the hollow pipe, may be used.

Subsequently, the hollow pipe after the hot forming is necessarily subjected to a solid solution heat treatment since various carbonitrides and intermetallic compounds are formed in the alloy through air cooling. Specifically, the temperature of the hollow pipe during the hot rolling is gradually decreased from the high temperature state in heating during the hot rolling. The pipe is often air cooled after the hot forming, and the temperature history thereof varies depending on the size and product types and cannot be controlled. Accordingly, there is a possibility that the corrosion resistant elements are consumed by becoming thermochemically stable precipitates in various temperature ranges during the decrease of the temperature, thereby decreasing the corrosion resistance. Furthermore, there is also a possibility that the phase transformation to the embrittled phase occurs to lower the low temperature toughness significantly. Moreover, for withstanding various corrosive environments, it is important that the alloy pipe as a product has a phase fraction of the microstructure of the alloy pipe that is the appropriate austenitic single phase. However, since the cooling rate from the heating temperature cannot be controlled, it is difficult to control the formation of the other phases than the austenitic phase, which sequentially vary depending on the retention temperature.

Due to the presence of the aforementioned problems, a solid solution heat treatment of quenching from a high heating temperature is frequently performed for the purposes of the solid solution of the precipitate in the alloy, the reverse transformation of the embrittled phase to a non-embrittled phase, and the achievement of the austenitic single phase state having a suitable phase fraction. With this treatment, the precipitate and the embrittled phase are dissolved in the alloy, and the alloy is controlled to the suitable austenitic single phase state. While the temperatures of the dissolution of the precipitate and the reverse transformation of the embrittled phase may slightly vary depending on the elements added, the temperature of the solid solution heat treatment is frequently a high temperature of 1,000° C. or more. Accordingly, in accordance with aspects of the present invention, the temperature of the solid solution heat treatment is preferably 1,000° C. or more, and more preferably 1,200° C. or more.

After heating to the solid solution heat treatment temperature, the hollow pipe is quenched for retaining the solid solution state, and compressed-air cooling and various cooling media, such as mist, oil, and water, may be used for quenching. In the case where the material temperature after the hot rolling is the same as the solid solution treatment temperature of the material, by performing the quenching immediately after the hot forming, the subsequent solid solution heat treatment may be omitted.

The material after the solid solution heat treatment is in an austenitic single phase having a low yield strength, and therefore a high yield strength cannot be achieved by itself. Accordingly, the pipe is highly strengthened through dislocation strengthening by various kinds of cold working. The strength grade of the alloy pipe after highly strengthening is determined by the tensile yield strength in the pipe axial direction.

In accordance with aspects of the present invention, the material (hollow pipe) after the solid solution heat treatment is highly strengthened by subjecting the pipe to bending and unbending work in the pipe circumferential direction as described below.

Bending and Unbending Work in Pipe Circumferential Direction

The cold rolling methods of a pipe that are standardized, for example, for mining of an oil well and a gas well include two method, i.e., cold drawing rolling and cold pilger rolling, both of which can perform the high strengthening in the pipe axial direction. In these methods, mainly the rolling reduction and the reduction rate of the outer diameter are changed to perform the high strengthening to the target strength grade. On the other hand, the cold drawing rolling and the cold pilger rolling are in a rolling mode, in which the outer diameter and the wall thickness of the pipe are reduced, and corresponding thereto, the pipe is largely extended in the pipe axial direction. Accordingly, there has been known a problem that the high strengthening can be readily achieved in the pipe axis tensile direction, but the Bauschinger effect largely occurs in the pipe axis compression direction, resulting in the decrease of the compressive yield strength in the pipe axial direction by approximately 20% at most with respect to the tensile yield strength in the pipe axial direction.

In PTL 1 described above, a heat treatment at a low temperature is performed after cold rolling for improving the decrease of the compressive yield strength in the pipe axial direction, and thereby the difference between the tensile yield strength in the pipe axial direction and the compressive yield strength in the pipe axial direction can be improved. However, the corrosion resistance capability is deteriorated through segregation of carbonitrides and Mo in the grain boundary. Under the circumstances, the present inventors have conceived a novel cold working method as a highly strengthening method of an alloy pipe that reduces the difference in strength between the tensile yield strength in the pipe axial direction and the compressive yield strength in the pipe axial direction, while retaining the "state where the corrosion resistant elements are solid-dissolved in the alloy" for retaining the corrosion resistance capability favorably.

Specifically, the cold working method according to aspects of the present invention is a novel method utilizing dislocation strengthening by bending and unbending work in the pipe circumferential direction. The method will be described with reference to FIG. 2 below.

As different from the cold drawing rolling and the cold pilger rolling where the rolling strain occurs in the pipe axis longitudinal direction, this method applies a strain by bending work through flattening the pipe (i.e., the first flattening work) and then by unbending work through returning to the true circle (i.e., the second flattening work), as shown in FIG. 2. In this method, the strain amount is controlled through the change of the repetition of bending and unbending and the change of the bending amount without a large change of the initial alloy pipe shape (i.e., the shape of the worked material).

In other words, the high strengthening of the alloy pipe through work hardening by using the cold working method according to aspects of the invention utilizes the strain in the pipe circumferential direction, whereas the ordinary cold rolling method utilizes the tensile strain in the pipe axial direction. Due to the control of the cold working method and the suppression of the strain in the pipe axial direction thereby, the method according to aspects of the present invention is in principle free of the Bauschinger effect in the pipe axial direction occurring in the ordinary cold rolling method. Consequently, according to aspects of the present invention, the low temperature heat treatment after the cold working can be omitted, and both the "state where the corrosion resistant elements are solid-dissolved in the alloy" required for achieving the good corrosion resistance capability and the high compressive yield strength in the pipe axial direction can be simultaneously achieved.

The cross sectional views of the cases where the number of the tool contact points is two are shown in (a) and (b) of FIG. 2, and the cross sectional view of the case where the number of the tool contact points is three is shown in (c) of FIG. 2. The thick arrows in FIG. 2 each show the direction of the force applied to the alloy pipe (which is the hollow pipe as the worked material, and may be hereinafter referred to as a "worked material") in performing the flattening work. As shown in FIG. 2, the operation may be performed in such a manner that the tool is moved or the position of the tool is shifted to rotate the alloy pipe, so that in performing the second flattening work, the tool is in contact with the part that has not been subjected to the first flattening work (the hatched part in FIG. 2 shows the first flattened part). For example, in the case where the number of the tool contact points is two, two mill rolls are disposed to face each other, and in the case where the number of the tool contact points is three, three mill rolls are disposed in the pipe circumferential direction at an interval of 120°.

As shown in FIG. 2, the bending and unbending work in the pipe circumferential direction flattening the alloy pipe is applied intermittently or continuously to the entire circumferential direction of the pipe, whereby the strain through bending is applied around the maximum value of the curvature of the alloy pipe (worked material), and the strain through unbending is applied toward the minimum value of the curvature of the alloy pipe. As a result, the strains through the bending and unbending deformation necessary for the strength enhancement (dislocation strengthening) of the resulting alloy pipe are accumulated in the entire alloy pipe. As different from the working mode performed by reducing the wall thickness and the outer diameter of the pipe, the use of this working mode has a characteristic feature that the pipe can be worked without large power while suppressing the shape change before and after the working to the minimum by the deformation through flattening.

The shape of the tool used for flattening the alloy pipe as in FIG. 2 may be a roll. The strains through the bending and unbending deformation can be readily applied repeatedly by flattening and rotating the alloy pipe among the two or more rolls disposed in the circumferential direction of the alloy pipe. The rotation axis of the roll may be tilted from the rotation axis of the pipe by 90° or less, and thereby the alloy pipe can move in the direction of the rotation axis of the pipe while receiving the flattening work, which readily enables the continuous working (see (a) and (b) in FIG. 2). Furthermore, in the continuous working with the rolls, for example, the curvatures (flattening amounts) of the alloy pipe in the first flattening work and the second flattening work can be readily changed by changing the distance between the rolls in an appropriate manner for changing the flattening amount with respect to the movement of the alloy pipe. Accordingly, the strain in the wall thickness direction can be homogenized by changing the moving path of the neutral line through the change of the distance between the rolls. The same effect can also be obtained by changing the flattening amount through the change of the diameters of the rolls but not the distance between the rolls. These procedures may be used in combination. The use of three rolls can suppress whirling of the pipe during the working, which enables the stable working, although a complicated equipment may be required therefor.

In the case where any of the working modes is used for the cold bending and unbending work according to aspects of the present invention, the working amount can be readily managed by the minimum radius in the bending work, i.e., the minimum diameter Dmin during deformation calculated from the flattening occurring under compression of the outer diameter from two points, or from twice of the minimum radius from the center of the alloy pipe in the triangular shape occurring in bending work from three points, with respect to the diameter Di of the initial alloy pipe. The working amount is also influenced by the initial wall thickness ti with respect to the diameter Di of the initial alloy pipe, and therefore the value ti/Di calculated therefrom may also be used in combination for the management. These parameters can be uniquely determined together by setting the product size and the production equipment.

In practicing aspects of the present invention, the more stable production satisfying the strength characteristics can be performed by managing the production condition through these parameters. As a result of the investigation on the stable production condition utilizing the parameters, a value obtained by multiplying the rolling reduction (%) calculated by (1−Dmin/Di)×100 by ti/Di calculated from the initial wall thickness ti and the diameter Di of the initial alloy pipe is used as an index. In the case where two units of the tool are used, and the index is in a range of 0.9 to 2.5, the stable production can be performed with the strength ratio (compressive yield strength in the pipe axial direction)/(tensile yield strength in the pipe axial direction) within a range of 0.85 to 1.15. The further stable production can be performed in the case where the index is in a range of 1.0 to 1.6.

In the case where three units of the tool are used, the range capable of performing the stable production is expanded. In the case where the index is in the range of 0.5 to 3.0, the alloy pipe can be produced with the strength ratio (compressive yield strength in the pipe axial direction)/(tensile yield strength in the pipe axial direction) within a range of 0.85 to 1.15. In the case where three units of the tool are used, the extremely stable production can be performed in the case where the index is in the range of 0.7 to 2.0.

In the high strengthening of the alloy pipe through the bending and unbending work in the pipe circumferential direction in accordance with aspects of the present invention, the Bauschinger effect in the pipe axial direction after working as in PTL 1 does not occur. Accordingly, the "state where the corrosion resistant elements are solid-dissolved in the alloy" can be retained without the necessity of the low temperature heat treatment, and thus the good corrosion resistance capability can be obtained. Therefore, after the cold working, a heat treatment including the low temperature treatment is in principle not performed.

However, even in the bending and unbending work in the pipe circumferential direction, which is the cold working method according to aspects of the present invention, the temperature of the worked material may be unavoidably increased in the production process, for example, the worked material may undergo working heat generation during the cold working and after the cold working due to the working heat generation in the cold working. Due to this, the same condition as in the low temperature heat treatment as in PTL 1 may occur. Therefore, it is necessary that the temperature of the worked material itself after the cold working is controlled to prevent from becoming the state of the low temperature heat treatment as in PTL 1.

Under the circumstances, as a result of the investigation by the present inventor performed on various temperature histories, the following has been found. In the case where the maximum temperature, to which the material is exposed after the cold working, is 300° C. or less for 15 minutes or less, the "state where the corrosion resistant elements are solid-dissolved in the alloy" is retained. Accordingly, for retaining the "state where the corrosion resistant elements are solid-dissolved in the alloy", and suppressing the segregation of Mo in the grain boundary in accordance with aspects of the present invention, when performing the cold bending and unbending work in the pipe circumferential direction, it suffices that the maximum reaching temperature of the worked material is 300° C. or less, and the retention time at the maximum reaching temperature is 15 minutes or less. For example, the maximum reaching temperature can be appropriately controlled by managing the working speed (i.e., the deformation speed in deforming into the flattened shape).

After the cold working, the resulting alloy pipe may be subjected to a surface treatment, such as a plating treatment, depending on necessity. The aforementioned condition for the worked material, i.e., the maximum reaching temperature of the worked material of 300° C. or less and the retention time of 15 minutes or less, is preferably satisfied in all the process steps after the cold working. For achieving this, in the process steps after the cold working, the surface treatment temperatures in the plating treatment and the like may be appropriately controlled to achieve the maximum reaching temperature of the worked material of 300° C. or less and the retention time of 15 minutes or less.

Subsequently, the production method of the thread joint will be described with reference to FIG. 5.

In accordance with aspects of the present invention, for the alloy pipe obtained above, an external thread and an internal thread may be designed in such a manner that on the cross section in the pipe axial direction (i.e., the cross section in parallel to the pipe axial direction) of the thread joint, the curvature radius R of the corner part 9, which is formed with the bottom surface of the thread root and the flank surface, is 0.2 mm or more.

The thread shape may be provided through cutting or rolling, and for stably providing the shape of the curvature radius R of the corner part 9, cutting is preferred. For further enhancing the capability of the thread joint, a premium joint is preferably used, which includes a metal touch sealing part and a torque shoulder part in addition of the thread part. The alloy pipe according to aspects of the present invention has a high compressive yield strength in the pipe axial direction, and thereby can exert the function as a joint with no problem by setting the cross sectional area of the shoulder part to 25% or more of the cross sectional area of the original pipe of the pin.

For achieving the high torque capability, it is preferred that the length L of the nose, which is a part without thread at the tip of the pin 1 shown in FIG. 5, is 0.2 inch or more and 0.5 inch or less, and assuming that the sealing point position from the pipe end is x, the ratio x/L of x with respect to the nose length L is 0.01 or more and 0.1 or less. On the other hand, for achieving the metal touch sealing part having high gas tightness, it is preferred that the length L of the nose, which is a part without thread at the tip of the pin 1, is 0.3 inch or more and 1.0 inch or less, and assuming that the sealing point position from the pipe end is x, the ratio x/L of x with respect to the nose length L is 0.2 or more and 0.5 or less. The "high torque capability" herein means that the torque value that does not cause deformation is increased, and thereby a higher fastening torque can be applied.

The alloy pipe according to aspects of the present invention can be produced by the production method described above.

According to aspects of the present invention as described above, the alloy pipe excellent in compressive strength characteristics having a strength ratio (compressive yield strength in the pipe axial direction)/(tensile yield strength in the pipe axial direction) within a range of 0.85 to 1.15 while suppressing the decrease of the corrosion resistance capability due to the segregation of Mo can be provided by performing the cold working method through bending and unbending and not performing the low temperature heat treatment.

Example 1

Aspects of the present invention will be then described with reference to examples.

The chemical components of the alloy types A to K shown in Table 1 each were melted in a vacuum melting furnace, and then hot-rolled into a round billet (raw material) having an outer diameter of 80 mm. In the alloy types J having Cr exceeding the scope of the present invention, no austenitic single phase was obtained. In the alloy types K having Mo added exceeding the scope of the present invention, cracks occurred in the solidification process after melting or in the hot rolling, and thus the investigation thereof was stopped before performing the cold working. The blank cell in Table 1 means no intentional addition, and includes not only the case where the component is not contained (0%) but also the case where the component is unavoidably contained.

wall thicknesses were provided with the subsequent outer rolling mill. The hollow pipes obtained through the hot rolling each were subjected to the solid solution heat treatment by heating again, and then quenching from the solid solution heat treatment temperature in a temperature range of 1,000 to 1,200° C.

The resulting hollow pipes in the "state where the corrosion resistant elements are solid-dissolved in the alloy" having various sizes (outer diameter: 88.9 mm, wall thickness: 5.4 to 7.5 mm (ti/Di=0.062 to 0.083); outer diameter: 104.4 mm, wall thickness: 15.1 to 22.3 mm (ti/Di=0.145 to 0.213); outer diameter: 139.7 mm, wall thickness: 9.0 to 12.1 mm (ti/Di=0.064 to 0.087); and outer diameter: 162.1 mm, wall thickness: 21.3 to 28.9 mm (ti/Di=0.132 to 0.178)) each were subjected to cold working. The cold working performed included not only the bending and unbending work in the pipe circumferential direction as the cold working method according to aspects of the present invention, but also drawing rolling and pilger rolling.

The bending and unbending work in the pipe circumferential direction was performed with an equipment of the mode having two mill rolls disposed to face each other or an equipment of the mode having three mill rolls disposed in the pipe circumferential direction at an interval of 1200 selected depending on the situation. The bending and unbending work was performed with the rolling management value, which was the value obtained by multiplying the rolling reduction ((1−Dmin/Di)×100(%)) by ti/Di calculated from the initial wall thickness ti and the diameter Di of the initial alloy pipe, which were obtained from the initial diameter Di (i.e., the diameter of the hollow pipe) and the initial wall thickness ti of the initial alloy pipe of the resulting base pipe (i.e., the hollow pipe after the solid solution heat treatment (worked material)) and the minimum

TABLE 1

(% by mass)

| Alloy types | C | Si | Mn | Cr | Ni | Mo | W | Cu | N | Ti | Al | V | Nb | B, Zr, Ca, Ta, REM, Sn, Sb | Microstructure | Remarks |
|---|---|---|---|---|---|---|---|---|---|---|---|---|---|---|---|---|
| A | 0.020 | 0.05 | 0.05 | 26.6 | 32.5 | 3.3 | | | 0.081 | | | | | | austenitic phase | Present Example |
| B | 0.013 | 0.10 | 0.10 | 25.6 | 49.6 | 3.4 | | | 0.042 | | | | | | austenitic phase | Present Example |
| C | 0.013 | 0.05 | 0.75 | 28 | 29.6 | 3.6 | | | 0.078 | | | | | | austenitic phase | Present Example |
| D | 0.014 | 0.05 | 0.10 | 14.6 | 56.8 | 16.5 | | | 0.042 | | | | | | austenitic phase | Present Example |
| E | 0.026 | 0.33 | 0.66 | 26.4 | 32.5 | 3.3 | 2.4 | 1.3 | 0.055 | | 0.040 | | | REM 0.03, Ta: 0.15 | austenitic phase | Present Example |
| F | 0.024 | 0.35 | 0.75 | 22.5 | 43.5 | 3.4 | | 2.4 | 0.057 | 1.100 | 0.200 | | | B: 0.003, Ca: 0.003, Zr: 0.010, Sn: 0.002, Sb: 0.002 | austenitic phase | Present Example |
| G | 0.021 | 0.33 | 0.55 | 26.3 | 31.5 | 3.1 | 0.4 | 0.3 | 0.055 | 0.004 | | | | | austenitic phase | Present Example |
| H | 0.017 | 0.08 | 0.25 | 26.1 | 32.3 | 3.1 | | | 0.085 | | | 0.030 | 0.040 | | austenitic phase | Present Example |
| I | 0.049 | 0.03 | 0.72 | 26.6 | 32.2 | 3.3 | 0.5 | 0.5 | 0.056 | | | | | | austenitic phase | Present Example |
| J | 0.013 | 0.66 | 0.10 | 36.8 | 22.6 | 5.5 | 3.0 | | 0.022 | | | | | | ferritic phase and austenitic phase | Comparative Example |
| K | 0.022 | 0.88 | 0.25 | 30.5 | 29.5 | 17.6 | 0.9 | | 0.036 | | | | | | austenitic phase and embrittled phase | Comparative Example |

underline: outside the scope of the invention
balance: Fe and unavoidable impurities A hollow original pipe was produced by hot piercing rolling, and hollow pipes having various outer diameters and outer diameter Dmin obtained from the roll gap of the rolling mill. For investigating the influence of the number of working, the condition where the cold working was performed twice under the same working condition was also performed. For a part of pipes, a low temperature heat treatment at the temperatures shown in Table 2 was performed after the cold working. The maximum reaching temperature of the worked material was managed by measuring the reached temperature in the production of the alloy pipe.

In the "minimum outer diameter Dmin obtained from the roll gap of the rolling mill" above, the roll gap of the rolling mill was the smallest part of the roll gap, which was the diameter of the true circle drawn in the gap of the rolls irrespective of the number of the rolls. The minimum outer diameter Dmin of the pipe was the same value as the roll gap.

The drawing rolling and the pilger rolling were performed as wall thickness reduction and extension rolling at a wall thickness reduction of 20% for an original pipe having an outer diameter of 139.7 mm and a wall thickness of 12 mm.

The resulting alloy pipes each were measured for the tensile yield strength and the compressive yield strength in the pipe axial direction and the compressive yield strength in the pipe circumferential direction. A bar tensile test piece having a diameter of the parallel portion of 4 to 6 mm and a cylinder compression test piece were collected from the center part of the pipe wall thickness of the resulting alloy pipe, and measured at a crosshead speed of 1 mm/min for both the tensile and compression tests. The tensile yield strength in the pipe axial direction, the strength ratio (compressive yield strength in the pipe axial direction)/(tensile yield strength in the pipe axial direction), and the strength ratio (compressive yield strength in the pipe circumferential direction)/(tensile yield strength in the pipe axial direction) were calculated.

A stress corrosion test under a chloride and sulfide environment was performed. The corrosion environment was an aqueous solution simulating an oil well under mining (obtained by adding $H_2S$ gas and $CO_2$ gas to a 25% NaCl aqueous solution containing 1,000 mg/L of sulfur under a pressure of 0.10 to 1.00 MPa, followed by controlling the pH thereof to 2.5 to 3.5, test temperature: 150° C.). For enabling the application of stress to the pipe axis longitudinal direction, a four-point bending test piece of 4 mm (in thickness) was cut out from the center in wall thickness of the resulting alloy pipe, or a round bar tensile test piece having a diameter of 8 mm was cut out from the center in wall thickness of the resulting alloy pipe, which was immersed in the aqueous solution under application of a stress of 100% to the tensile yield strength in the pipe axial direction. The corrosion state was evaluated in such a manner that the test piece under application of stress was immersed in the corrosion aqueous solution for 720 hours, and then taken out therefrom, and immediately the surface of the test piece applied with the stress was visually observed. The test piece with no crack was evaluated with a symbol "A", and the test piece with cracks or fracture was evaluated with a symbol "B".

The resulting alloy pipes each were subjected to a crystal orientation analysis with EBSD for the wall thickness direction of the cross section of the pipe in parallel to the pipe axial direction, and the aspect ratio of the austenite grain separated at a crystal orientation angle of 15°. The measured area was 1.2 mm×1.2 mm, and an austenite grain having 10 μm or more in terms of the diameter of the true circle having the same area was measured for the aspect ratio.

Thereafter, the area fraction of the austenite grains having an aspect ratio of 9 or less in the entire microstructure was measured. For the area fraction, the crystal grain was defined with a boundary having a difference in crystal orientation angle of 15° or more in the crystal orientation analysis as the grain boundary, and the aspect ratio was obtained from the lengths of the long side and the short side of the crystal grain. The area fraction of the proportion of an aspect ratio of 9 or less occupied in the entire measured microstructure was obtained.

The concentration of Mo (% by mass) was measured for the region of (a width from both ends of the austenite grain boundary to 150 nm from the austenite grain boundary)×(a length of 2 nm in the direction in parallel to the grain boundary) at an interval of 0.2 nm with STEM. The measured area corresponded to the grain boundary and was at the position of the hatched part corresponding to the grain boundary shown in FIG. 1. The Mo concentration (% by mass) obtained from the measurement result of the grain boundary of the austenitic phase was the maximum value (peak value) in the measured area. The Mo concentration (% by mass) in the grains of the austenitic phase was the average value of the measured area. The value obtained by dividing each of the maximum values by each of the average values (peak value/average value), i.e., the Mo concentration of the grain boundary of the austenitic phase with respect to the Mo concentration in the grains of the austenitic phase (the values of "austenite grain boundary/austenite grain" in Table 3), was obtained. In the calculation of the average value in the grain of the austenitic phase, the average value was calculated excluding the region from the edge of the grain boundary of the austenitic phase by 0 to 50 nm.

The results obtained are shown in Table 3.

TABLE 2

| Pipe No. | Alloy types | Working method | Number of work pass | Number of rolls — | Rolling management value — | Low temperature heat treatment temperature ° C. | Maximum reaching temperature ° C. | Retention time min | Remarks |
|---|---|---|---|---|---|---|---|---|---|
| 1 | A | drawing rolling | 1 | — | — | — | 230 | 2 | Comparative Example |
| 2 | A | pilger rolling | 1 | — | — | — | 220 | 4 | Comparative Example |
| 3 | A | pilger rolling | 1 | — | — | 450 | 220 | 4 | Comparative Example |
| 4 | E | drawing rolling | 1 | — | — | — | 230 | 2 | Comparative Example |
| 5 | E | drawing rolling | 1 | — | — | 300 | 230 | 2 | Comparative Example |
| 6 | E | drawing rolling | 1 | — | — | 500 | 230 | 2 | Comparative Example |
| 7 | F | drawing rolling | 1 | — | — | — | 230 | 2 | Comparative Example |
| 8 | F | drawing rolling | 1 | — | — | 350 | 230 | 2 | Comparative Example |
| 9 | A | bending and unbending | 1 | 3 | 1.2 | — | 130 | 2 | Present Example |
| 10 | A | bending and unbending | 1 | 2 | 1.1 | — | 110 | 3 | Present Example |
| 11 | A | bending and unbending | 1 | 2 | 1.9 | — | 180 | 1 | Present Example |
| 12 | A | bending and unbending | 1 | 3 | 1.5 | — | 110 | 13 | Present Example |
| 13 | A | bending and unbending | 1 | 3 | 2.5 | — | 260 | 2 | Present Example |

TABLE 2-continued

| Pipe No. | Alloy types | Working method | Number of work pass | Number of rolls — | Rolling management value — | Low temperature heat treatment temperature ° C. | Maximum reaching temperature ° C. | Reten-tion time min | Remarks |
|---|---|---|---|---|---|---|---|---|---|
| 14 | B | bending and unbending | 1 | 3 | 1.2 | — | 110 | 2 | Present Example |
| 15 | B | bending and unbending | 2 | 3 | 1.3 | — | 110 | 4 | Present Example |
| 16 | B | pilger rolling | 1 | — | — | — | 110 | 3 | Comparative Example |
| 17 | C | bending and unbending | 1 | 3 | 1.3 | — | 120 | 2 | Present Example |
| 18 | D | bending and unbending | 1 | 3 | 1.2 | — | 120 | 2 | Present Example |
| 19 | E | bending and unbending | 1 | 3 | 1.4 | — | 130 | 2 | Present Example |
| 20 | F | bending and unbending | 2 | 3 | 1.5 | — | 280 | 8 | Present Example |
| 21 | G | bending and unbending | 1 | 3 | 1.3 | — | 120 | 3 | Present Example |
| 22 | G | drawing rolling | 1 | — | — | — | 120 | 2 | Comparative Example |
| 23 | H | drawing rolling | 1 | — | — | 400 | 220 | 2 | Comparative Example |
| 24 | H | pilger rolling | 2 | — | — | — | 220 | 2 | Comparative Example |
| 25 | H | pilger rolling | 1 | — | — | 450 | 250 | 3 | Comparative Example |
| 26 | H | bending and unbending | 1 | 2 | 1.5 | — | 180 | 2 | Present Example |
| 27 | H | bending and unbending | 1 | 3 | 1.3 | — | 130 | 2 | Present Example |
| 28 | H | bending and unbending | 2 | 3 | 0.9 | — | 150 | 3 | Present Example |
| 29 | I | bending and unbending | 1 | 3 | 1.3 | — | 170 | 2 | Present Example |
| 30 | I | drawing rolling | 1 | — | — | — | 160 | 3 | Comparative Example |
| 31 | J | bending and unbending | 1 | 3 | 1.3 | — | 160 | 2 | Comparative Example |
| 32 | K*[1] | — | — | — | — | — | — | — | Comparative Example |

*[1]cracked before cold working due to embrittled phase

TABLE 3

| Pipe No. | Alloy types | Tensile yield strength in pipe axial direction MPa | Aspect ratio | Area fraction of aspect ratio of 9 or less % | Compressive yield strength in pipe axial direction/ tensile yield strength in pipe axial direction | Compressive yield strength in pipe circumferential direction MPa | Compressive yield strength in pipe circumferential direction/ tensile yield strength in pipe axial direction | Austenite grain boundary/ austenite grain times | Cracking A/B | Remarks |
|---|---|---|---|---|---|---|---|---|---|---|
| 1 | A | 866 | 9.2 | 15 | 0.83 | 871 | 1.01 | 1.65 | A | Comparative Example |
| 2 | A | 872 | 9.7 | 16 | 0.84 | 911 | 1.04 | 1.77 | A | Comparative Example |
| 3 | A | 898 | 9.7 | 16 | 0.86 | 923 | 1.03 | 6.44 | B | Comparative Example |
| 4 | E | 866 | 9.3 | 10 | 0.82 | 879 | 1.02 | 1.62 | A | Comparative Example |
| 5 | E | 889 | 9.3 | 11 | 0.85 | 913 | 1.03 | 4.99 | B | Comparative Example |
| 6 | E | 912 | 9.3 | 11 | 0.87 | 921 | 1.01 | 8.25 | B | Comparative Example |
| 7 | F | 884 | 9.1 | 16 | 0.82 | 899 | 1.02 | 1.58 | A | Comparative Example |
| 8 | F | 889 | 9.1 | 16 | 0.86 | 898 | 1.01 | 4.61 | B | Comparative Example |
| 9 | A | 879 | 3.4 | 86 | 1.01 | 889 | 1.01 | 1.55 | A | Present Example |
| 10 | A | 870 | 3.8 | 85 | 1.02 | 887 | 1.02 | 1.56 | A | Present Example |
| 11 | A | 878 | 4.2 | 83 | 1.04 | 895 | 1.02 | 1.57 | A | Present Example |
| 12 | A | 888 | 3.4 | 85 | 1.01 | 895 | 1.01 | 1.55 | A | Present Example |
| 13 | A | 912 | 3.8 | 83 | 1.02 | 935 | 1.03 | 1.56 | A | Present Example |
| 14 | B | 872 | 3.8 | 75 | 1.03 | 895 | 1.03 | 1.55 | A | Present Example |
| 15 | B | 899 | 3.9 | 73 | 1.04 | 922 | 1.03 | 1.94 | A | Present Example |
| 16 | B | 889 | 9.3 | 13 | 0.83 | 896 | 1.01 | 1.93 | A | Comparative Example |
| 17 | C | 875 | 4.6 | 65 | 1.05 | 889 | 1.02 | 1.75 | A | Present Example |
| 18 | D | 863 | 4.8 | 62 | 1.08 | 881 | 1.02 | 2.89 | A | Present Example |
| 19 | E | 880 | 3.3 | 86 | 1.01 | 903 | 1.03 | 1.54 | A | Present Example |
| 20 | F | 955 | 3.3 | 92 | 0.96 | 1011 | 1.06 | 3.56 | A | Present Example |
| 21 | G | 925 | 3.8 | 85 | 1.01 | 944 | 1.02 | 1.77 | A | Present Example |
| 22 | G | 918 | 10.1 | 10 | 0.83 | 922 | 1.00 | 1.81 | A | Comparative Example |
| 23 | H | 876 | 9.1 | 10 | 0.87 | 892 | 1.02 | 4.85 | B | Comparative Example |
| 24 | H | 881 | 10.3 | 8 | 0.84 | 902 | 1.02 | 2.53 | A | Comparative Example |
| 25 | H | 881 | 10.2 | 8 | 0.88 | 902 | 1.02 | 5.69 | B | Comparative Example |
| 26 | H | 895 | 3.8 | 78 | 1.04 | 921 | 1.03 | 1.25 | A | Present Example |
| 27 | H | 912 | 3.6 | 80 | 1.01 | 928 | 1.02 | 1.15 | A | Present Example |
| 28 | H | 956 | 3.6 | 82 | 1.02 | 985 | 1.03 | 1.24 | A | Present Example |
| 29 | I | 885 | 3.9 | 85 | 1.02 | 895 | 1.01 | 1.59 | A | Present Example |
| 30 | I | 889 | 10.1 | 21 | 0.83 | 891 | 1.00 | 1.61 | A | Comparative Example |
| 31 | J | 812 | 3.8 | 45 | 1.03 | 835 | 1.03 | 1.58 | B | Comparative Example |
| 32 | K | — | — | — | — | — | — | — | — | Comparative Example |

*—*in table shows unmeasurable due to failure of cold working.

It is found from the results in Table 3 that in all the present examples, the ratio of the Mo concentration of the grain boundary of the austenitic phase with respect to the Mo concentration in the grains of the austenitic phase, which shows the segregation amount of Mo, is 4.0 times or less. Accordingly, the present examples are excellent in corrosion resistance and excellent in tensile yield strength in the pipe axial direction, and have a small difference between the tensile yield strength and the compressive yield strength in the pipe axial direction. On the other hand, in the comparative examples, i.e., the product produced by the ordinary cold rolling method and the product subjected to the subsequent low temperature heat treatment, any of the ratio of the tensile yield strength and the compressive yield strength in the pipe axial direction and the corrosion resistance does not satisfy the acceptance standard.

Example 2

Subsequently, the thread joints were evaluated.

A trapezoidal thread part was formed through machining at the end of the alloy pipe obtained in Example 1 (see FIG. 3(*a*)), and two alloy pipes were fastened through the threads. Thereafter, a fatigue test of the thread part was performed by rotating the fastened alloy pipes in the state where the both ends of the pipes were eccentric by 3 to 10% corresponding to the tensile yield strength in the pipe axial direction of the fastened alloy pipes. The curvature radius R of the corner part as the stress concertation part of the thread part was changed as shown in Table 4, and the number of rotation until the fracture of the thread due to the fatigue cracks in the stress concentration part and the progress of the fatigue cracks was investigated. Thereafter, the results of the fatigue test of the alloy pipes obtained by the ordinary method (i.e., the alloy pipes subjected to drawing rolling or pilger rolling as the cold working method in the comparative examples in Example 1) and the alloy pipes according to aspects of the present invention were compared, and the ratio with respect to the ordinary production method was indicated. The ratio is shown in Table 4 as "Fatigue test results". An alloy pipe having the ratio exceeding 1 was evaluated as being excellent, and the effect of extending the fatigue life was evaluated.

As shown in Table 4, for the alloy types A, B, G, H, and I as the present examples, a thread joint including a pin having an outer diameter D of 88.9 mm and a wall thickness t of 5.5 mm or 6.5 mm (alloy pipe size) and a corresponding coupling, a thread joint including a pin having an outer diameter D of 244.5 mm and a wall thickness t of 13.8 mm and a corresponding coupling, and a thread joint including a pin having an outer diameter D of 139.7 mm and a wall thickness t of 14.3 mm and a corresponding coupling were prepared. As for the type of the thread joint, a joint including only a thread part and a premium joint including a thread part, a sealing part, and a shoulder part were prepared and subjected to the aforementioned fatigue test.

Table 4 shows the curvature radii R of the corner parts of the load flank and the stabbing flank on the bottom surface of the thread root of the pin.

TABLE 4

| | | | | | Curvature radius of corner part (mm) | | | | | |
|---|---|---|---|---|---|---|---|---|---|---|
| | | | | Thread | Pin | Pin | Coupling | Coupling | Result of fatigue test | |
| Pipe No. | Alloy types | Steel pipe size (pin) | Thread type | fatigue test No. | Load flank | Stabbing flank | Load flank | Stabbing flank | Compared No. | Fatigue properties |
| 16 | B | D 88.9 mm t 6.5 mm | premium joint | B-1 | 0.2 | 0.2 | 0.2 | 0.2 | — | — |
| | | | | B-2 | 0.4 | 0.4 | 0.4 | 0.4 | — | — |
| | | | | B-3 | 0.6 | 0.6 | 0.6 | 0.6 | — | — |
| | | | | B-4 | 0.1 | 0.1 | 0.1 | 0.1 | B-1 | 0.74 |
| 15 | | | | B-5 | 0.2 | 0.2 | 0.2 | 0.2 | B-1 | 1.30 |
| | | | | B-6 | 0.4 | 0.4 | 0.4 | 0.4 | B-2 | 1.21 |
| | | | | B-7 | 0.6 | 0.6 | 0.6 | 0.6 | B-3 | 1.16 |
| 14 | | | | B-8 | 0.2 | 0.2 | 0.2 | 0.2 | B-1 | 1.43 |
| | | | | B-9 | 0.4 | 0.4 | 0.4 | 0.4 | B-2 | 1.31 |
| | | | | B-10 | 0.6 | 0.6 | 0.6 | 0.6 | B-3 | 1.27 |
| 2 | A | D 244.5 mm t 13.8 mm | premium joint | A-1 | 0.2 | 0.2 | 0.2 | 0.2 | — | — |
| | | | | A-2 | 0.4 | 0.4 | 0.4 | 0.4 | — | — |
| | | | | A-3 | 0.6 | 0.6 | 0.6 | 0.6 | — | — |
| | | | | A-4 | 0.1 | 0.1 | 0.1 | 0.1 | A-1 | 0.71 |
| 11 | | | | A-5 | 0.2 | 0.2 | 0.2 | 0.2 | A-1 | 1.43 |
| | | | | A-6 | 0.4 | 0.4 | 0.4 | 0.4 | A-2 | 1.38 |
| | | | | A-7 | 0.6 | 0.6 | 0.6 | 0.6 | A-3 | 1.37 |
| 9 | | | | A-8 | 0.2 | 0.2 | 0.2 | 0.2 | A-1 | 1.56 |
| | | | | A-9 | 0.4 | 0.4 | 0.4 | 0.4 | A-2 | 1.53 |
| | | | | A-10 | 0.6 | 0.6 | 0.6 | 0.6 | A-3 | 1.47 |
| 22 | G | D 88.9 mm t 5.5 mm | thread only | G-1 | 0.2 | 0.2 | 0.2 | 0.2 | — | — |
| | | | | G-2 | 0.3 | 0.3 | 0.3 | 0.3 | — | — |
| | | | | G-3 | 0.6 | 0.6 | 0.6 | 0.6 | — | — |
| | | | | G-4 | 0.1 | 0.1 | 0.1 | 0.1 | G-1 | 0.61 |
| 21 | | | | G-5 | 0.2 | 0.2 | 0.2 | 0.2 | G-1 | 1.55 |
| | | | | G-6 | 0.3 | 0.3 | 0.3 | 0.3 | G-2 | 1.49 |
| | | | | G-7 | 0.6 | 0.6 | 0.6 | 0.6 | G-3 | 1.49 |
| 24 | H | D 88.9 mm t 6.5 mm | premium joint | H-1 | 0.2 | 0.2 | 0.2 | 0.2 | — | — |
| | | | | H-2 | 0.4 | 0.4 | 0.4 | 0.4 | — | — |
| | | | | H-3 | 1.2 | 1.2 | 1.2 | 1.2 | — | — |
| 28 | | | | H-4 | 0.2 | 0.2 | 0.2 | 0.2 | H-1 | 1.78 |
| | | | | H-5 | 0.4 | 0.4 | 0.4 | 0.4 | H-2 | 1.68 |
| | | | | H-6 | 1.2 | 1.2 | 1.2 | 1.2 | H-3 | 1.67 |
| 27 | | | | H-7 | 0.2 | 0.2 | 0.2 | 0.2 | H-1 | 1.81 |
| | | | | H-8 | 0.4 | 0.4 | 0.4 | 0.4 | H-2 | 1.77 |
| | | | | H-9 | 1.2 | 1.2 | 1.2 | 1.2 | H-3 | 1.76 |
| 30 | I | D 139.7 mm t 14.3 mm | premium joint | I-1 | 0.2 | 0.2 | 0.2 | 0.2 | — | — |
| | | | | I-2 | 0.7 | 0.7 | 0.7 | 0.7 | — | — |
| | | | | I-3 | 2.5 | 2.5 | 2.5 | 2.5 | — | — |
| | | | | I-4 | 0.1 | 0.1 | 0.1 | 0.1 | I-1 | 0.72 |

TABLE 4-continued

| Pipe No. | Alloy types | Steel pipe size (pin) | Thread type | Thread fatigue test No. | Curvature radius of corner part (mm) Pin Load flank | Pin Stabbing flank | Coupling Load flank | Coupling Stabbing flank | Result of fatigue test Compared No. | Fatigue properties |
|---|---|---|---|---|---|---|---|---|---|---|
| 29 | | | | I-5 | 0.2 | 0.2 | 0.2 | 0.2 | I-1 | 1.18 |
| | | | | I-6 | 0.7 | 0.7 | 0.7 | 0.7 | I-2 | 1.17 |
| | | | | I-7 | 2.5 | 2.5 | 2.5 | 2.5 | I-3 | 1.14 |

It is found from the results in Table 4 that the alloy pipes according to aspects of the present invention are all excellent in fatigue properties.

Subsequently, a premium joint was evaluated for the design of the torque shoulder part. As shown in Table 5, a fastening test (a yield torque evaluation test) was performed for a thread joint (premium joint) including a pin having an outer diameter D of 88.9 mm, a wall thickness t of 6.5 mm, and a tensile strength of 689 MPa and a corresponding coupling.

TABLE 5

| Pipe No. | Alloy types | Thread fatigue test No. | Steel pipe size (pin) | Nose length L (inch) | x/L | Cross sectional area ratio of shoulder part | Thread test result Yield torque (N · m) |
|---|---|---|---|---|---|---|---|
| 2 | A | A-1 | D 88.9 mm | 0.25 | 0.03 | 20% | 2900 |
| | | A-2 | t 6.5 mm | | | 20% | 2900 |
| | | A-3 | | | | 20% | 2900 |
| 9 | | A-4 | | | | 20% | 4200 |
| | | A-5 | | | | 20% | 4200 |
| | | A-6 | | | | 20% | 4200 |
| 24 | H | H-1 | D 88.9 mm | 0.45 | 0.09 | 25% | 3400 |
| | | H-2 | t 6.5 mm | | | 25% | 3400 |
| | | H-3 | | | | 25% | 3400 |
| 28 | | H-4 | | | | 25% | 4500 |
| | | H-5 | | | | 25% | 4500 |
| | | H-6 | | | | 25% | 4500 |
| 27 | | H-7 | | | | 50% | 6000 |
| | | H-8 | | | | 50% | 6000 |
| | | H-9 | | | | 50% | 6000 |

Specifically, it was found that in the case where the cross sectional area of the shoulder part was less than 20% of the cross sectional area of the non-worked part of the pin, yield occurred at a fastening torque of 3,000 N·m. Accordingly, it was found that in the case where the cross sectional area of the shoulder part was 20% or more of the cross sectional area of the non-worked part of the pin, yield occurred at 4,000 N·m or more, and the fastening can be achieved with a sufficiently high torque secured. This value was necessarily 25% or more for the ordinary alloy pipe having a low compression resistance strength, and therefore the advantage of the alloy pipe according to aspects of the present invention was confirmed, i.e., the equivalent torque was secured with a cross sectional area of the shoulder part of 20% or more of the cross sectional area of the non-worked part of the pin. The "cross sectional area ratio of shoulder part" shown in Table 5 means the cross sectional area ratio of the shoulder part with respect to the cross sectional area of the non-worked part of the pin.

As another thread joint with high performance, a thread joint having a high sealability capable of passing the sealing test of ISO 13679:2019 can be exemplified. As shown in Table 6, the sealing test was performed for a thread joint (premium joint) including a pin having an outer diameter D of 88.9 mm, a wall thickness t of 6.5 mm, and a tensile strength of 689 MPa and a corresponding coupling, and a thread joint (premium joint) including a pin having an outer diameter D of 244.5 mm and a wall thickness t of 13.8 mm and a corresponding coupling.

TABLE 6

| Pipe No. | Alloy types | Thread fatigue test No. | Steel pipe size (pin) | Nose length L (inch) | x/L | Sealing test Sealability Compression ratio (%) |
|---|---|---|---|---|---|---|
| 2 | A | A-1 | D 88.9 mm | 0.35 | 0.25 | 79 |
| | | A-2 | t 6.5 mm | | | 79 |
| | | A-3 | | | | 79 |
| 9 | | A-4 | | | | 100 |
| | | A-5 | | | | 100 |
| | | A-6 | | | | 100 |
| 24 | H | H-1 | D 244.5 mm | 0.9 | 0.45 | 86 |
| | | H-2 | t 13.8 mm | | | 86 |
| | | H-3 | | | | 86 |
| 28 | | H-4 | | | | 100 |
| | | H-5 | | | | 100 |
| | | H-6 | | | | 100 |
| 27 | | H-7 | | | | 100 |
| | | H-8 | | | | 100 |
| | | H-9 | | | | 100 |

It was found from the results in Tables 5 and 6 that the application of the alloy pipe according to aspects of the present invention enabled a thread joint capable of being fastened even with a small shoulder cross sectional area. Accordingly, the degree of freedom in designing a thread joint can be enhanced thereby. Furthermore, the following two kinds of high performance thread joints can be achieved.

The first high performance thread joint is a high torque thread joint capable of securing the sealability even in application of a high fastening torque. The application of the alloy pipe having a high compression resistance strength according to aspects of the present invention to the thread joint can provide the high torque capability. In addition, the further high torque capability can be achieved by optimizing the design of the thread joint. Specifically, the thread joint is designed in such a manner that the length L of the nose, which is the part without thread at the tip of the pin, is 0.2 inch or more and 1.0 inch or less, and the ratio x/L of the sealing point position x from the pipe end with respect to the nose length L is 0.01 or more and 0.1 or less.

In view of the results of the sealing test, for achieving a metal touch sealing part having high gas tightness, it is preferred that the length L of the nose, which is the part without thread at the tip of the pin, is 0.3 inch or more and 1.0 inch or less, and the ratio x/L of the sealing point position x from the pipe end with respect to the nose length L is 0.2 or more and 0.5 or less. As described above, in the case where the nose length L is increased to separate the sealing point from the end of the pipe, the cross sectional area of the shoulder part is decreased to such a cross sectional area that causes a problem of yield with the ordinary material, which makes the design impossible. This problem becomes conspicuous in the ordinary material with a thin profile, and the thread joint cannot be achieved with a thickness of 6.5 mm. With the alloy pipe according to aspects of the present invention having a high compression resistance strength, the problem of yield can be avoided by securing the cross sectional area of the shoulder part of 20% or more. Accordingly, the simultaneous achievement of the securement of the cross sectional area of the shoulder part and the design with high sealability can be achieved.

As shown in Table 6, it was confirmed that in the case where the strength ratio (compressive yield strength in the pipe axial direction)/(tensile yield strength in the pipe axial direction) was 0.85 or more, the thread joint passed the sealing test with a compression ratio of 85% under the test load of Iso 13679:2019. It was also confirmed that in the case where the strength ratio (compressive yield strength in the pipe axial direction)/(tensile yield strength in the pipe axial direction) was 1.0 or more, the thread joint passed the sealing test with a compression ratio of 100%.

REFERENCE SIGN LIST

1 pin
2 box
3 torque shoulder part
4 metal touch sealing part
5 thread part
6 external thread
7 internal thread
8 flank surface
9 corner part
10*b* load flank surface
11*a* stabbing flank surface
12 coupling

The invention claimed is:

1. A method for producing an alloy pipe comprising, as a component composition, in terms of % by mass, Cr: 11.5-35.0% Ni: 23.0-60.0%, and Mo: 0.5-17.0%, the alloy pipe being a steel alloy pipe having an austenitic phase as a microstructure, having a Mo concentration (% by mass) in a grain boundary of the austenitic phase that is 4.0 times or less than a Mo concentration (% by mass) within grains of the austenitic phase, and having a tensile yield strength in a pipe axial direction of 689 MPa or more and a ratio of compressive yield strength in a pipe axial direction to tensile yield strength in the pipe axial direction of 0.85 to 1.15, the method comprising, after a solid solution heat treatment, performing cold bending and unbending work in a pipe circumferential direction, wherein a maximum achieving temperature of a worked material after the cold bending and unbending work is 300° C. or less, and wherein the cold bending and unbending work is performed such that a rolling management value falls within a predetermined range, the rolling management value obtained by multiplying (1−Dmin/Di)×100 by ti/Di, wherein Di is an initial diameter of the alloy pipe, Dmin is a minimum diameter of the alloy pipe during the cold bending and unbending, and ti is an initial wall thickness of the alloy pipe, and wherein the predetermined range is 0.5 to 3.0.

2. A method for producing the alloy pipe according to claim 1, wherein the alloy pipe contains, in addition to the component composition, in terms of % by mass, C: 0.05% or less, Si: 1.0% or less, Mn: 5.0% or less, N: less than 0.400% optionally one or two or more selected from W: 5.5% or less, Cu: 4.0% or less, V: 1.0% or less, and Nb: 1.0% or less, optionally one or two selected from Ti: 1.5% or less and Al: 0.30% or less, and optionally one or two or more selected from B: 0.010% or less, Zr: 0.010% or less, Ca: 0.010% or less, Ta: 0.30% or less, Sb: 0.30% or less, Sn: 0.30% or less, and REM: 0.20% or less, with the balance of Fe and unavoidable impurities.

3. The method for producing the alloy pipe according to claim 2, wherein a retention time at the maximum achieving temperature is 15 minutes or less.

4. A method for producing the alloy pipe according to claim 1, wherein the alloy pipe has a ratio of compressive yield strength in a pipe circumferential direction to tensile yield strength in the pipe axial direction of 0.85 or more, and wherein the alloy pipe contains, in addition to the component composition, in terms of % by mass, C: 0.05% or less, Si: 1.0% or less, Mn: 5.0% or less, N: less than 0.400% optionally one or two or more selected from W: 5.5% or less, Cu: 4.0% or less, V: 1.0% or less, and Nb: 1.0% or less, optionally one or two selected from Ti: 1.5% or less and Al: 0.30% or less, and optionally one or two or more selected from B: 0.010% or less, Zr: 0.010% or less, Ca:

0.010% or less, Ta: 0.30% or less, Sb: 0.30% or less, Sn: 0.30% or less, and REM: 0.20% or less, with the balance of Fe and unavoidable impurities.

5. The method for producing the alloy pipe according to claim 4, wherein a retention time at the maximum achieving temperature is 15 minutes or less.

6. The method for producing the alloy pipe according to claim 1, wherein a retention time at the maximum achieving temperature is 15 minutes or less.

* * * * *